US010927426B2

(12) United States Patent
Kawamura

(10) Patent No.: US 10,927,426 B2
(45) Date of Patent: Feb. 23, 2021

(54) COOLING EQUIPMENT FOR CONTINUOUS ANNEALING FURNACE

(71) Applicant: NIPPON STEEL & SUMITOMO METAL CORPORATION, Tokyo (JP)

(72) Inventor: Hirohisa Kawamura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 274 days.

(21) Appl. No.: 16/090,781

(22) PCT Filed: Apr. 5, 2016

(86) PCT No.: PCT/JP2016/061149
§ 371 (c)(1),
(2) Date: Oct. 2, 2018

(87) PCT Pub. No.: WO2017/175311
PCT Pub. Date: Oct. 12, 2017

(65) Prior Publication Data

US 2020/0071781 A1 Mar. 5, 2020

(51) Int. Cl.
*C21D 1/667* (2006.01)
*F27D 9/00* (2006.01)
(Continued)

(52) U.S. Cl.
CPC ..... *C21D 1/667* (2013.01); *C21D 1/613* (2013.01); *C21D 9/46* (2013.01); *C21D 11/005* (2013.01);
(Continued)

(58) Field of Classification Search
CPC ..... C21D 1/667; C21D 1/613; C21D 9/46; C21D 9/56; C21D 9/561; F27D 9/00; F27D 2009/0075
See application file for complete search history.

(56) References Cited

U.S. PATENT DOCUMENTS

2001/0045024 A1 11/2001 Mignard et al.
2010/0200126 A1 8/2010 Onozawa et al.
(Continued)

FOREIGN PATENT DOCUMENTS

EP 1549776 B1 11/2006
JP 55-1969 B2 1/1980
(Continued)

OTHER PUBLICATIONS

Extended European Search Report, dated Jul. 22, 2019, for European Application No. 16897870.8.
(Continued)

*Primary Examiner* — Scott R Kastler
(74) *Attorney, Agent, or Firm* — Birch, Stewart, Kolasch & Birch, LLP

(57) ABSTRACT

Cooling equipment comprising: a plurality of injection units in a continuous annealing furnace including heating zone, soaking zone, and cooling zone through which strip-shaped steel sheet is sequentially fed, the injection units arranged in cooling zone in row along feed direction of steel sheet and injecting, from injection nozzles, cooling gas containing hydrogen, onto steel sheet; and hydrogen concentration adjustment unit adjusts hydrogen concentration of cooling gas such that hydrogen concentration distribution is formed in which, in a space of the cooling zone where plurality of injection units are disposed, hydrogen concentration at upstream region is higher than hydrogen concentration at downstream region; plurality of injection nozzles arranged along feed direction of steel sheet, and each of injection nozzles extending toward steel sheet; and injection nozzles positioned at both sides in array direction inclined to slope toward a center of the array direction on progression toward tips of injection nozzles.

3 Claims, 19 Drawing Sheets

(51) Int. Cl.
*C21D 1/613* (2006.01)
*C21D 9/46* (2006.01)
*C21D 11/00* (2006.01)

(52) U.S. Cl.
CPC ..... *F27D 9/00* (2013.01); *F27D 2009/0075* (2013.01)

(56) References Cited

U.S. PATENT DOCUMENTS

| | | | | |
|---|---|---|---|---|
| 2012/0205842 | A1* | 8/2012 | Kobayashi ..... | C21D 9/5735 266/251 |
| 2013/0213298 | A1 | 8/2013 | Onozawa et al. | |

FOREIGN PATENT DOCUMENTS

| | | | |
|---|---|---|---|
| JP | 4-210429 | A | 7/1992 |
| JP | 6-93342 | A | 4/1994 |
| JP | 9-95741 | A | 4/1997 |
| JP | 9-235626 | A | 9/1997 |
| JP | 11-808430 | A | 3/1999 |
| JP | 11-236625 | A | 8/1999 |
| JP | 11-335744 | A | 12/1999 |
| JP | 2002-3954 | A | 1/2002 |
| JP | 2002-206117 | A | 7/2002 |
| JP | 2003-277835 | A | 10/2003 |
| JP | 2004-307904 | A | 11/2004 |
| JP | 2005-60738 | A | 3/2005 |
| JP | 2006-183075 | A | 7/2006 |
| JP | 3847831 | B2 | 11/2006 |
| JP | 2012-12692 | A | 1/2012 |
| WO | WO 2008/044716 | A1 | 4/2008 |

OTHER PUBLICATIONS

International Search Report for PCT/JP2016/061149 (PCT/ISA/210) dated Jul. 5, 2016.

Delaunay et al., "Flash Cooling technology for the production of high strength galvanised steels", Steel Times International—Jan./Feb. 2011, total of 4 pages.

Written Opinion of the International Searching Authority for PCT/JP2016/061149 (PCT/ISA/237) dated Jul. 5, 2016.

* cited by examiner

COOLING EQUIPMENT FOR CONTINUOUS ANNEALING FURNACE

TECHNICAL FIELD

The present invention relates to cooling equipment applied in a cooling zone of a continuous annealing furnace including a heating zone, a soaking zone, and the cooling zone through which a strip-shaped steel sheet is sequentially fed. In particular, the present invention relates to cooling equipment that injects cooling gas to which hydrogen has been added onto the steel sheet to cool the steel sheet.

BACKGROUND ART

After cold rolling a steel sheet, the material of the steel sheet is hardened by plastic deformation, and so there is a need to process the steel sheet by annealing to soften the hardened material. Normally the process of annealing is performed in a continuous annealing furnace that includes a heating zone, a soaking zone, and a cooling zone (see, for example, Patent Documents 1 to 8). In a continuous annealing furnace, a strip-shaped steel sheet is sequentially fed through the heating zone, the soaking zone, and the cooling zone.

In the process of annealing by such a continuous annealing furnace, the higher the speed of cooling after soaking the steel sheet, namely, the speed of cooling from starting cooling the steel sheet in the cooling zone, the higher the strength obtained for a small alloy amount.

Therefore, in the process of annealing by such a continuous annealing furnace, in order to raise the speed of cooling from starting cooling the steel sheet in the cooling zone, a cooling gas to which hydrogen has been added is injected onto the steel sheet. Such a method enables the speed of cooling of the steel sheet to be raised due to hydrogen having a heat transfer coefficient that is about seven times that of nitrogen.

RELATED ART

Patent Document 1: Japanese Patent Application Publication (JP-B) No. S55-1969
Patent Document 2: Japanese Patent Application Laid-Open (JP-A) No. H9-235626
Patent Document 3: JP-A No. H11-80843
Patent Document 4: JP-A No. 2002-3954
Patent Document 5: JP-A No. 2005-60738
Patent Document 6: JP-A No. H11-236625
Patent Document 7: JP-A No. H11-335744
Patent Document 8: JP-A No. 2003-277835

SUMMARY OF INVENTION

Technical Problem

However, due to the generally high cost of hydrogen, there is a desire to reduce the amount of hydrogen used in order to reduce the manufacturing cost of the steel sheet.

An object of the present invention is accordingly to provide cooling equipment for a continuous annealing furnace that is cooling equipment capable of reducing the amount of hydrogen used while still raising the speed of cooling from starting cooling a steel sheet in a cooling zone.

Solution to Problem

In order to solve the above problem, cooling equipment for a continuous annealing furnace, the cooling equipment comprising: a plurality of injection units disposed in a continuous annealing furnace including a heating zone, a soaking zone, and a cooling zone through which a strip-shaped steel sheet is sequentially fed, the plurality of injection units each being arranged in the cooling zone in a row along a feed direction of the steel sheet and injecting, from a plurality of injection nozzles, a cooling gas to which hydrogen has been added, onto the steel sheet; and a hydrogen concentration adjustment unit that adjusts hydrogen concentration of the cooling gas that is injected from each of the plurality of injection units such that a hydrogen concentration distribution is formed in which, in a space of the cooling zone where the plurality of injection units are disposed, a hydrogen concentration at an upstream region is higher than a hydrogen concentration at a downstream region; each plurality of injection nozzles in the plurality of injection units being arranged with an array direction along the feed direction of the steel sheet, and each of the plurality of injection nozzles extending toward the steel sheet; and at least injection nozzles positioned at both sides in the array direction in each of the plurality of injection nozzles are inclined so as to slope toward a center of the array direction on progression toward tips of the injection nozzles.

Advantageous Effects

Cooling equipment for a continuous annealing furnace according to an aspect of the present invention enables a reduction in the amount of hydrogen used while still raising the speed of cooling from starting cooling a steel sheet in the cooling zone.

DESCRIPTION OF EMBODIMENTS

First Exemplary Embodiment

A first exemplary embodiment of the present invention will first be described.

Figure 1:
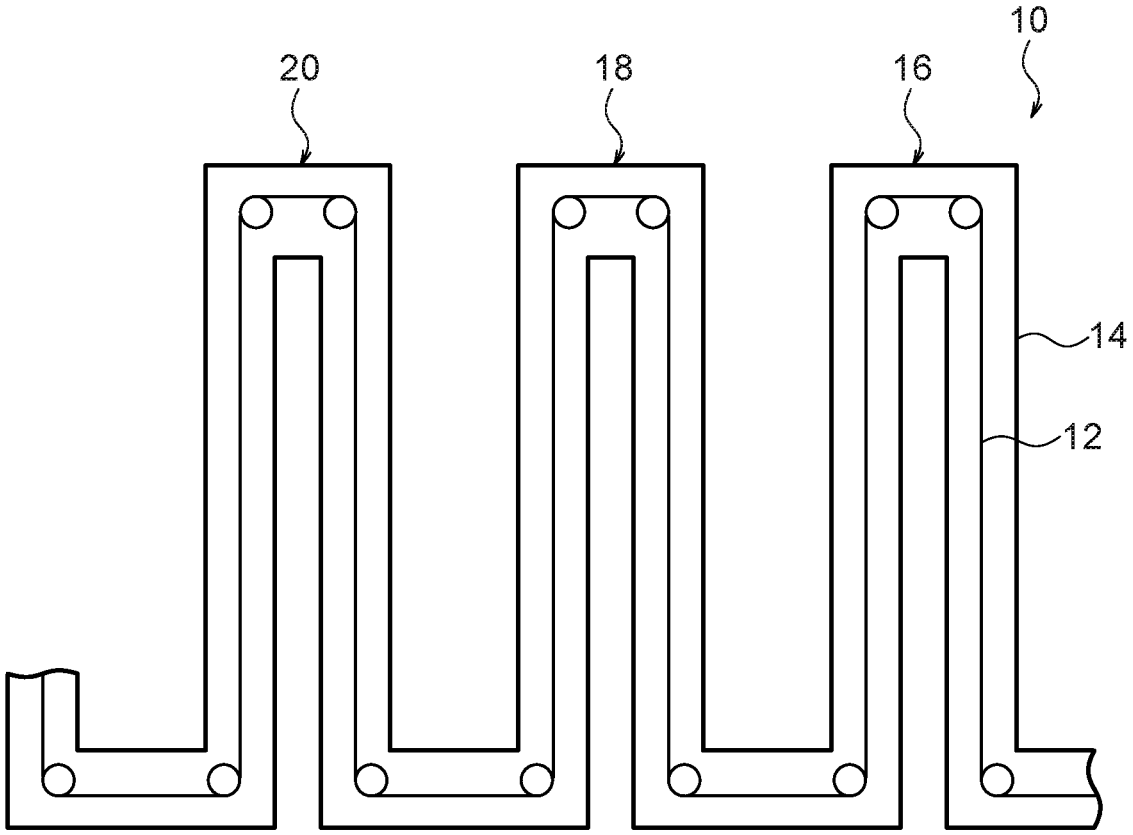
FIG. 1 is a face-on view illustrating a continuous annealing furnace.

A continuous annealing furnace 10 illustrated in FIG. 1 is employed in processing to anneal a strip-shaped steel sheet 12 after cold rolling, and includes a tube shaped furnace body 14. The furnace body 14 includes a heating zone 16, a soaking zone 18, and a cooling zone 20 for each processes in the processing. The steel sheet 12 is fed in sequence through the heating zone 16, the soaking zone 18, and the cooling zone 20. The steel sheet 12 is heated in the heating zone 16, the steel sheet 12 is held in a uniform temperature state in the soaking zone 18, and the steel sheet 12 is cooled in the cooling zone 20.

Figure 2:
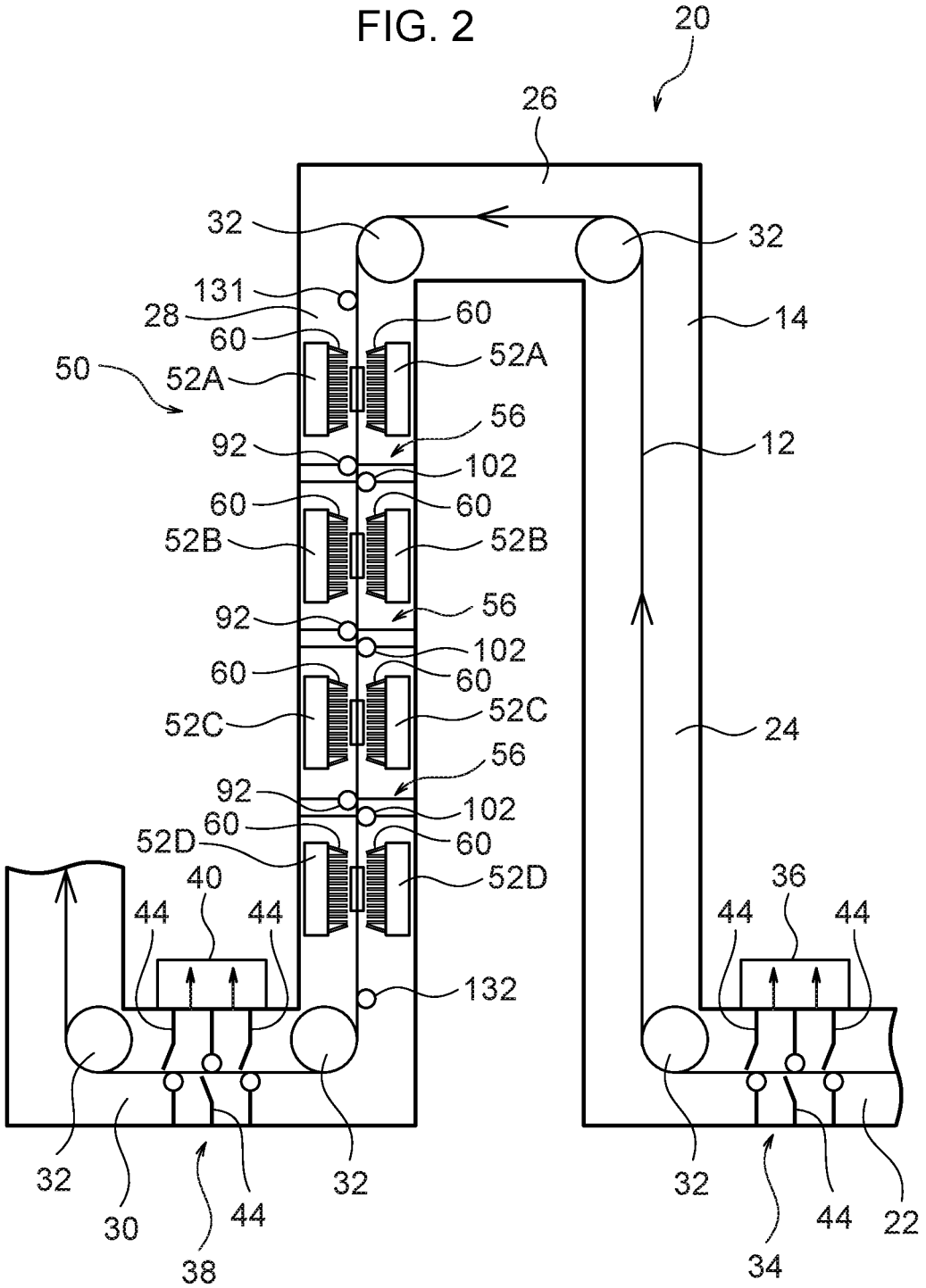
FIG. 2 is a face-on view illustrating a cooling zone where cooling equipment according to a first exemplary embodiment of the present invention is applied.

As illustrated in FIG. 2, cooling equipment 50 according to a first exemplary embodiment of the present invention is applied to the cooling zone 20 of the continuous annealing furnace 10 described above. In the cooling zone 20, the furnace body 14 includes an entry-pass space 22, an up-pass space 24, an intermediate-pass space 26, a down-pass space 28, and an exit-pass space 30. The entry-pass space 22, the exit-pass space 30, and the intermediate-pass space 26 extend in a horizontal direction, and the up-pass space 24 and the down-pass space 28 extend in an up-down direction (vertical direction).

The upstream end of the up-pass space 24 is connected to the downstream end of the entry-pass space 22. The intermediate-pass space 26 is coupled to the downstream end of the up-pass space 24 and the upstream end of the down-pass space 28. The downstream end of the down-pass space 28 is connected to the upstream end of the exit-pass space 30.

The steel sheet 12 is fed from the entry-pass space 22 toward the exit-pass space 30. The steel sheet 12 is fed upward in the up-down direction in the up-pass space 24. The steel sheet 12 is fed downward in the up-down direction in the down-pass space 28. Moreover, the steel sheet 12 is fed along a horizontal direction in the entry-pass space 22, the intermediate-pass space 26, and the exit-pass space 30.

Turn rolls 32 to change the direction of the steel sheet 12 are respectively provided at the downstream end of the entry-pass space 22, the upstream end of the intermediate-pass space 26, the downstream end of the intermediate-pass space 26, the upstream end of the exit-pass space 30, and the downstream end of the exit-pass space 30.

In addition to the cooling equipment 50 according to the first exemplary embodiment of the present invention, described in detail later, an entry sealing device 34, an entry exhaust device 36, an exit sealing device 38, an exit sealing device 38, and an exit exhaust device 40 are also provided in the cooling zone 20.

Figure 3:
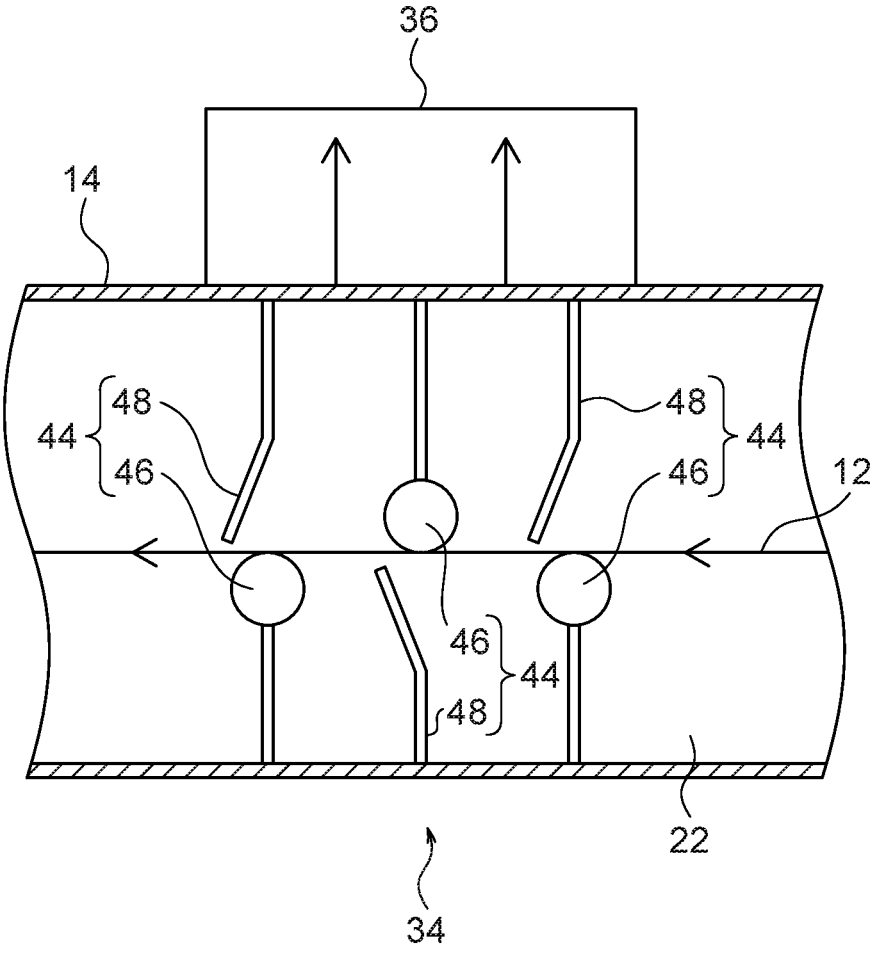
FIG. 3 is a face-on view including a partial cross-section of peripheral portions of an entry sealing device of FIG. 2.

The entry sealing device 34 is provided in the entry-pass space 22. As illustrated in FIG. 3, the entry sealing device 34 includes plural seal sets 44. The plural seal sets 44 are disposed in a row along the length direction of the entry-pass space 22.

Each of the seal sets 44 includes a support roll 46 and a thermal insulation member 48 that oppose each other along the up-down direction. The support rolls 46 and the thermal insulation members 48 are arranged so as to be positioned in the entry-pass space 22 on both sheet thickness direction sides of the steel sheet 12.

In each of the seal sets 44, the support roll 46 supports the steel sheet 12, and a leading end portion of the thermal insulation member 48 is either in close proximity to the steel sheet 12, or contacts the steel sheet 12. The thermal insulation member 48 is, for example, configured by a flexible member such as a fiber blanket. The support roll 46 and the thermal insulation member 48 are arranged in opposite positions to each other in adjacent seal sets 44 from the plural seal sets 44.

The entry exhaust device 36 is provided at a position corresponding to the entry sealing device 34. The entry exhaust device 36 is actuated so as to externally exhaust cooling gas from the entry-pass space 22. An air intake of the entry exhaust device 36 is, as an example, configured by an opening between the plural seal sets 44 provided in the entry sealing device 34.

The exit sealing device 38 and the exit exhaust device 40 illustrated in FIG. 2 are configured similarly to the entry sealing device 34 and the entry exhaust device 36 described above. The exit sealing device 38 is provided in the exit-pass space 30 and includes plural seal sets 44. The exit exhaust device 40 is provided at a position corresponding to the exit sealing device 38, and is actuated so as to externally exhaust cooling gas from the exit-pass space 30.

Figure 4:
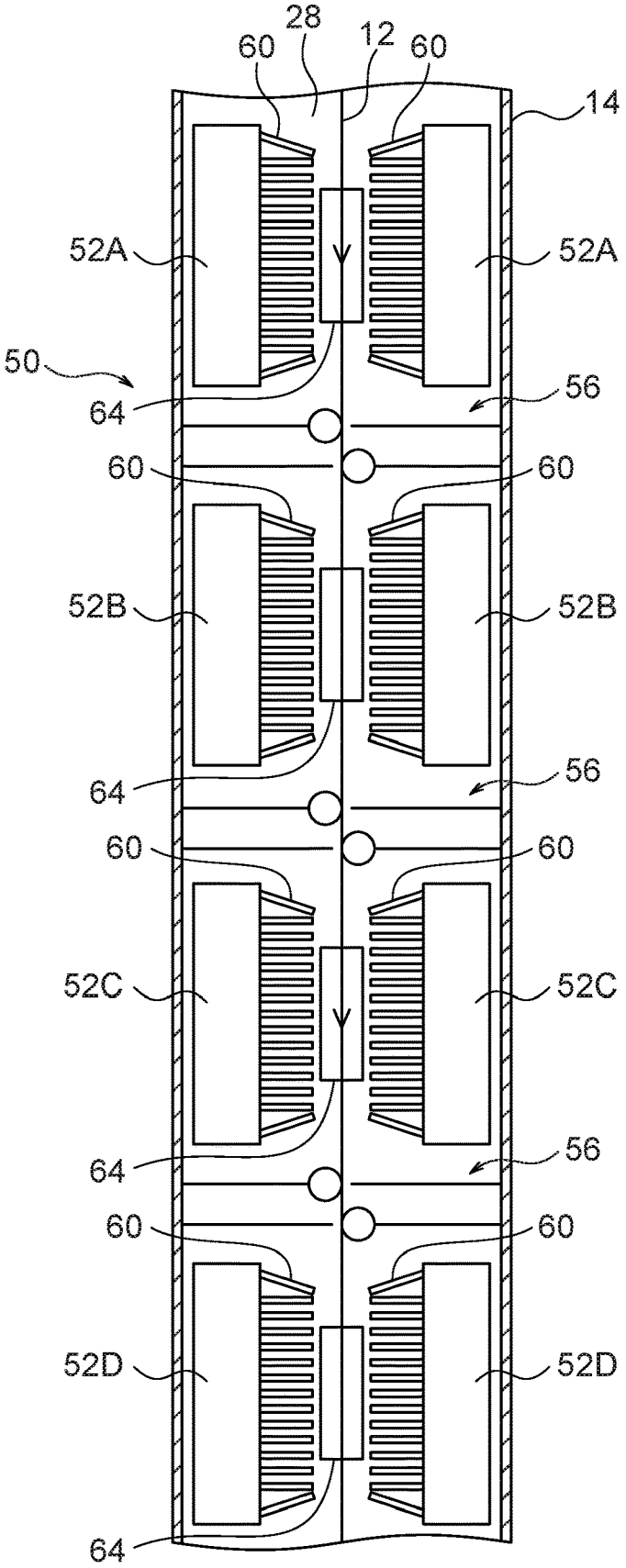
FIG. 4 is a face-on view including a partial cross-section of plural injection devices of FIG. 2.

The cooling equipment 50 according to the first exemplary embodiment of the present invention is employed to cool the steel sheet 12. As illustrated in FIG. 4, the cooling equipment 50 includes plural injection devices 52A to 52D, and plural intermediate sealing devices 56. The plural injection devices 52A to 52D and the plural intermediate sealing devices 56 are, as an example, disposed in the down-pass space 28 of the cooling zone 20.

The plural injection devices 52A to 52D are employed to inject cooling gas onto the steel sheet 12, and correspond to "plural injection units" of the present invention. The plural injection devices 52A to 52D are arranged in a row along the up-down direction of the down-pass space 28 from the upper side to the lower side, namely, are arranged in the down-pass space 28 in sequence from upstream to downstream in the feed direction of the steel sheet 12.

Plural injection devices 52A, 52B from out of the plural injection devices 52A to 52D are arranged at the upper side, namely upstream, of a central portion in the up-down direction of the down-pass space 28. Plural injection devices 52C, 52D from out of the plural injection devices 52A to 52D are arranged at the lower side, namely downstream, of a central portion in the up-down direction of the down-pass space 28.

Moreover, the plural injection devices 52A to 52D are each respectively arranged so as to be disposed on both sides across the steel sheet 12. One of the plural respective injection devices 52A to 52D faces toward one sheet face of the steel sheet 12, and another of the plural respective injection devices 52A to 52D faces toward the other sheet face of the steel sheet 12.

Figure 5:
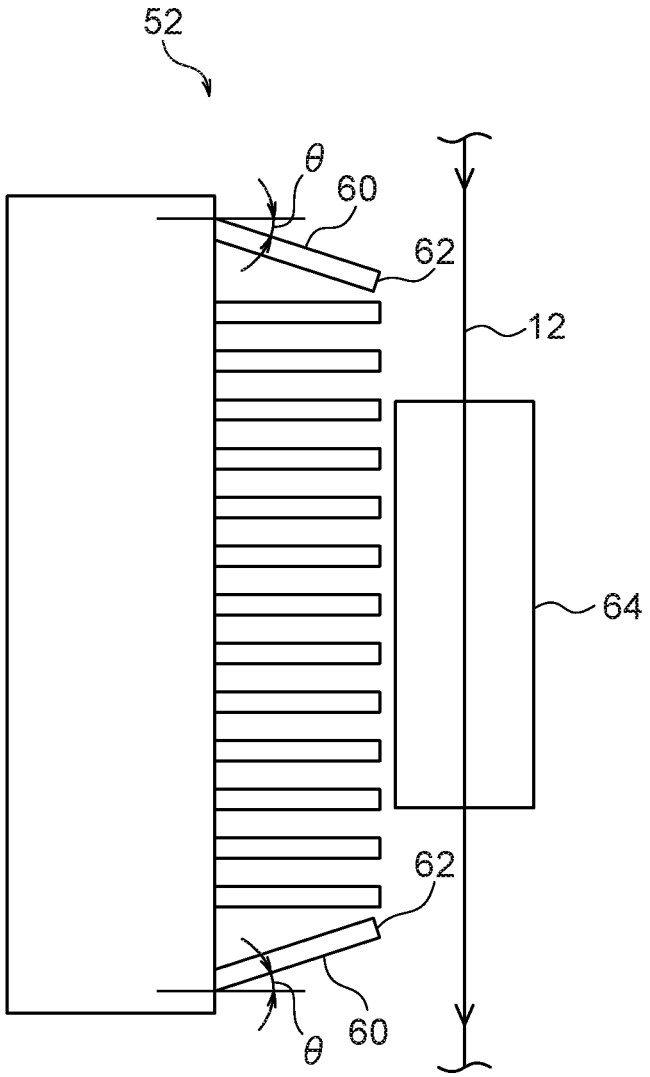
FIG. 5 is a side view of an injection device of FIG. 4.

The plural injection devices 52A to 52D are each configured the same as each other. When describing the plural respective injection devices 52A to 52D in general, the plural respective injection devices 52A to 52D will be referred to below simply as injection devices 52. As illustrated in FIG. 5, each of the injection devices 52 has what is referred to as a high speed gas jet type of configuration, and includes plural injection nozzles 60 formed with straight tubular shapes. Note that the injection nozzles 60 may have another shape other than a pipe shape, such as a slit shape, as long as they are capable of injecting gas at high speed.

The plural injection nozzles 60 extend toward the steel sheet 12, and injection ports 62 for injecting cooling gas are formed at the tips of the plural injection nozzles 60. The tips of the plural injection nozzles 60 are arranged at a limit of proximity to the steel sheet 12 such that the tips do not impede the steel sheet 12 being fed downward in the up-down direction.

The plural injection nozzles 60 are arranged with an array direction along the feed direction of the steel sheet 12. In the first exemplary embodiment, the array direction of the plural injection nozzles 60 is aligned with the up-down direction of the injection devices 52. Note that the plural injection nozzles 60 are also arranged with the width direction of the steel sheet 12 aligned with the width direction of the injection devices 52.

From out of the plural injection nozzles 60, the injection nozzles 60 that are positioned at both up-down direction sides of the injection devices 52 are inclined so as to slope toward the center side in the up-down direction of the injection devices 52 on progression toward the tips of the injection nozzles 60. An inclination angle θ of these injection nozzles 60 to the front-rear direction of the injection devices 52 is, for example, set at from about 20° to about 45°. If the inclination angle θ is less than 20°, then it is difficult to obtain the advantageous effect on the spreading of cooling gas up and down, as described later. However, if the inclination angle θ is greater than 45°, then the separation distance in the injection direction from the tips of the injection nozzles 60 to the steel sheet 12 becomes too great, and there is a reduction in the cooling effect of the cooling gas injected from the injection nozzles 60.

However, the remaining plural injection nozzles 60 from out of the plural injection nozzles 60, other than the injection nozzles 60 referred to above that are positioned at both up-down direction sides, extend in the front-rear direction of the injection devices 52, namely, in normal directions towards sheet faces of the steel sheet 12.

Figure 6:
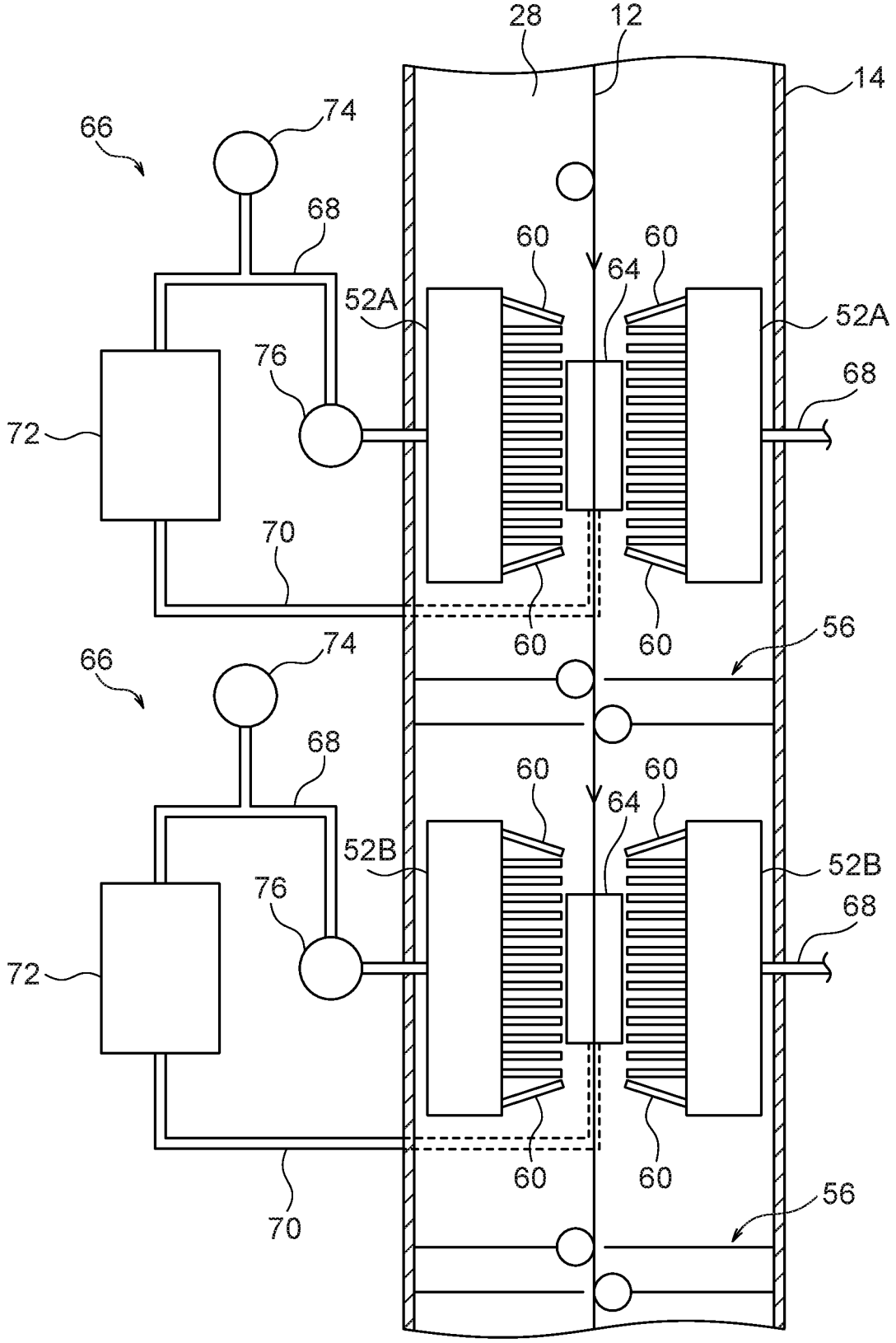
FIG. 6 is a face-on view including a partial cross-section of peripheral portions of an upstream injection device of FIG. 4.

As illustrated in FIG. 6, an air intake port 64 is provided between the pair of mutually facing injection devices 52A to suck in the cooling gas injected from the pair of injection devices 52A. The air intake port 64 is disposed between the injection nozzles 60 positioned at both sides in the up-down direction of the injection devices 52A. The air intake port 64 and the pair of injection devices 52A are connected through a circulation system 66.

The circulation system 66 includes an out-path pipe 68, a return-path pipe 70, a heat exchanger 72, a hydrogen supply source 74, and a blower 76. The heat exchanger 72 is connected to the air intake port 64 through the return-path pipe 70. The pair of injection devices 52A are connected to the heat exchanger 72 through the out-path pipe 68. The heat exchanger 72 cools the cooling gas using air cooling or water cooling.

The hydrogen supply source 74 is connected to the out-path pipe 68, and is actuated so as to supply hydrogen (hydrogen gas) into the out-path pipe 68. Hydrogen is added to the cooling gas that is injected from the pair of injection devices 52A by hydrogen being supplied from the hydrogen supply source 74 into the out-path pipe 68. The blower 76 is provided on the out-path pipe 68, and is actuated so as to inject cooling gas from the pair of injection devices 52A, and so as to circulate the cooling gas between the air intake port 64 and the pair of injection devices 52A.

As illustrated in FIG. 6, an air intake port 64 and a circulation system 66, which are similar to the above air intake port 64 and circulation system 66 provided to the pair of injection devices 52A, are provided to the pair of injection devices 52B. Moreover, an air intake port 64 and a circulation system 66, which are similar to the above air intake port 64 and circulation system 66 provided to the pair of injection devices 52A, are provided to each pair of injection devices 52C, 52D illustrated in FIG. 7.

The hydrogen supply source 74 in each of the plural circulation systems 66 provided to the plural injection devices 52A to 52D corresponds to a "hydrogen concentration adjustment unit" of the present invention. The flow rate of hydrogen supplied to each of the plural injection devices 52A to 52D is adjustable by respective flow rate adjustment valves or the like.

Note that, as well as the added hydrogen, nitrogen is also included in the cooling gas injected from the plural injection devices 52A to 52D. Moreover, hydrogen obtained by decomposition of ammonia may, for example, be employed as the hydrogen added to the cooling gas.

The cooling gas injected from the plural injection devices 52A to 52D is preferably set with a hydrogen content of from about 10% to about 70% by volume. The reason that a cooling gas is employed with a hydrogen content of from about 10% to about 70% by volume is in order to be able to achieve both a cooling effect on the steel sheet 12 and cost effectiveness.

Namely, if the hydrogen in the cooling gas exceeds about 70% by volume, then the heat transfer coefficient becomes saturated and a high cooling effect is no longer obtainable, and a high cost is incurred. However, when the hydrogen in the cooling gas is less than about 10% by volume, the desired cooling effect is no longer obtainable. Thus by employing a cooling gas with a hydrogen content of from about 10% to about 70% by volume, sufficient cooling effect on the steel sheet 12 is secured, while also enabling cost effectiveness to be secured.

As illustrated in FIG. 4, the plural intermediate sealing devices 56 are arranged along the feed direction of the steel sheet 12. The plural intermediate sealing devices 56 are disposed respectively between the pair of injection devices 52A and the pair of injection devices 52B, between the pair of injection devices 52B and the pair of injection devices 52C, and between the pair of injection devices 52C and the pair of injection devices 52D.

Figure 8:
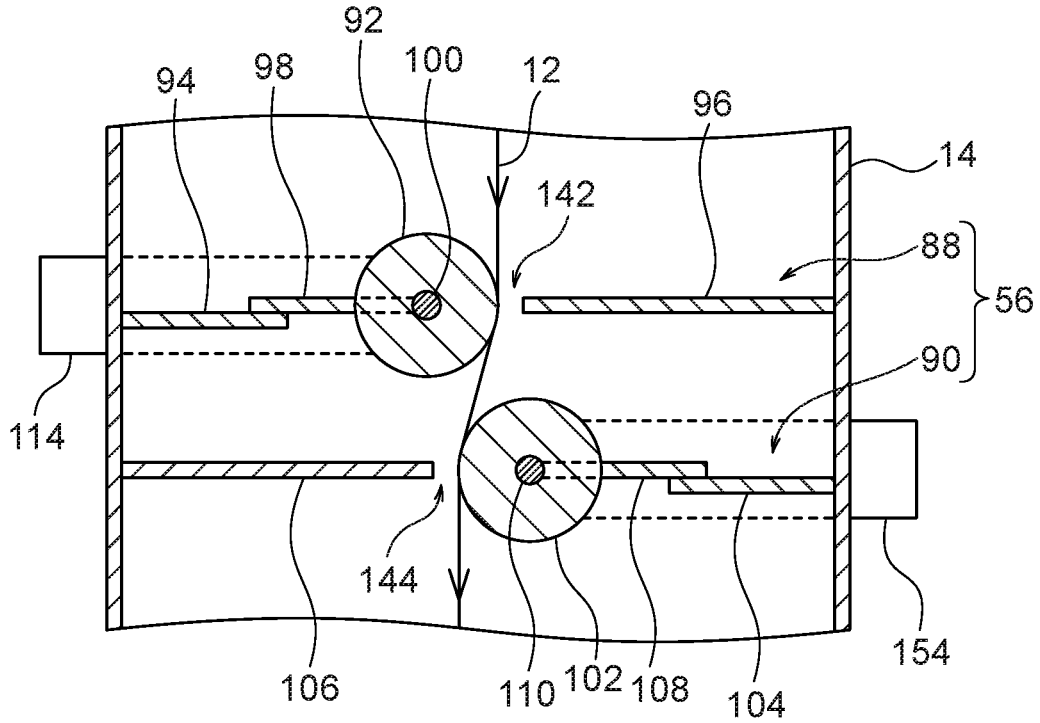
FIG. 8 is a face-on view including a partial cross-section of peripheral portions of an intermediate sealing device of FIG. 4, and is a diagram illustrating a contact state of an upstream support roll and a downstream support roll with a steel sheet.
Figure 9:
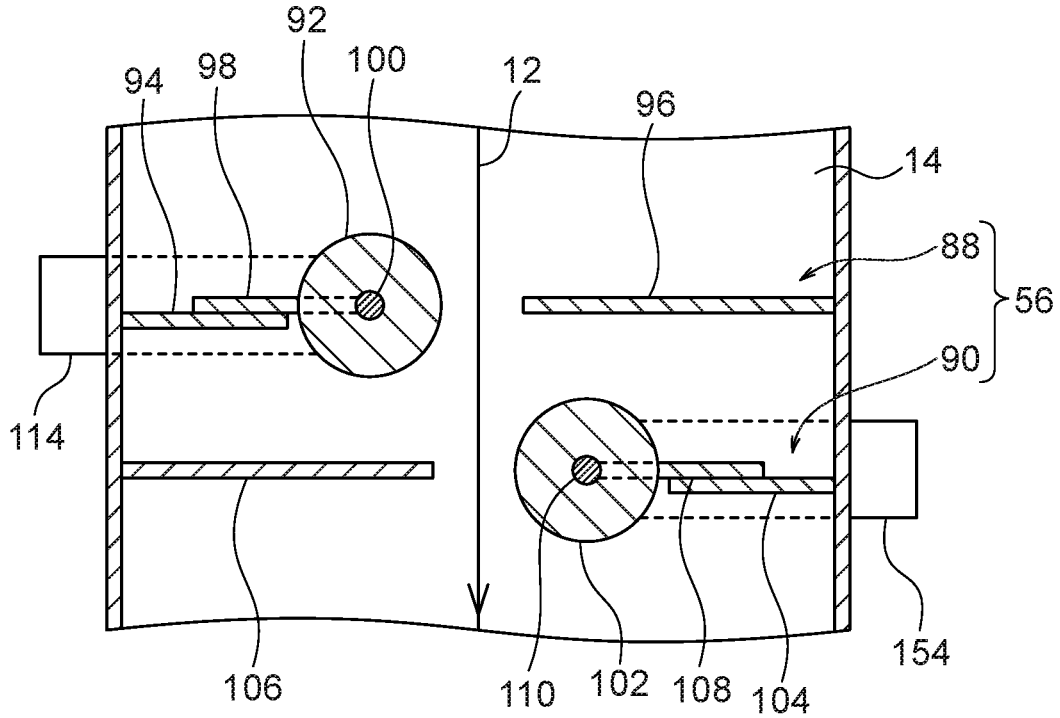
FIG. 9 is a face-on view including a partial cross-section of peripheral portions of the intermediate sealing device of FIG. 4, and is a diagram illustrating a separated state of an upstream support roll and a downstream support roll from a steel sheet.

The plural intermediate sealing devices 56 are each configured the same as each other. As illustrated in FIG. 8 and FIG. 9, each of the intermediate sealing devices 56 includes an upstream seal section 88 and a downstream seal section 90. The upstream seal section 88 is configured by an upstream support roll 92, an upstream first seal 94, an upstream second seal 96, and an upstream roll seal 98. The downstream seal section 90 is configured by a downstream support roll 102, a downstream first seal 104, a downstream second seal 106, and a downstream roll seal 108.

The upstream support roll 92 and the downstream support roll 102 are arranged with their axial directions along the width direction of the steel sheet 12. The upstream support roll 92 and the downstream support roll 102 are rotatably supported by respective rotation shafts 100, 110 that extend in the width direction of the steel sheet 12. The upstream support roll 92 is disposed on one sheet thickness direction side of the steel sheet 12, and the downstream support roll 102 is disposed on the other sheet thickness direction side of the steel sheet 12. Moreover, the downstream support roll 102 is disposed at the lower side of the upstream support roll 92 in the up-down direction, namely, is disposed downstream of the upstream support roll 92 in the feed direction of the steel sheet 12.

Figure 10:
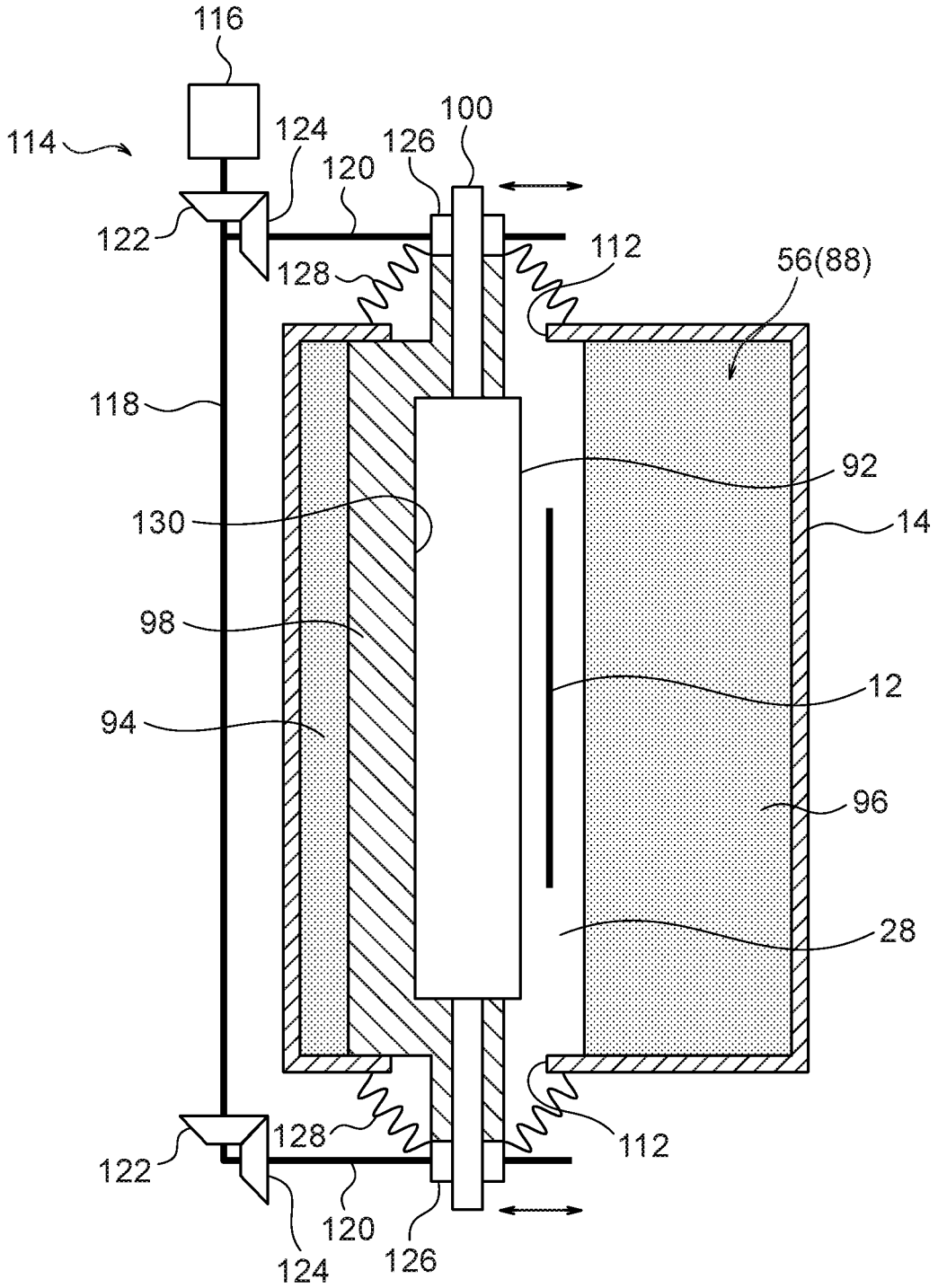
FIG. 10 is a plan view including a partial cross-section of peripheral portions of an upstream sealing device in the intermediate sealing device of FIG. 4, and is a diagram illustrating a separated state of the upstream support roll from a steel sheet.

In the furnace body 14, as illustrated in FIG. 10, a pair of guide holes 112 are formed so as to penetrate through both end portions of the rotation shaft 100. The pair of guide holes 112 are formed as elongated holes extending in a direction orthogonal to the axial direction of the rotation shaft 100 in plan view. The upstream support roll 92 is capable of contacting the steel sheet 12 and separating from the steel sheet 12 by the rotation shaft 100 being guided by the pair of guide holes 112.

In the furnace body 14, guide holes similar to those of the pair of guide holes 112 illustrated in FIG. 10 are also formed in the downstream support roll 102 illustrated in FIG. 8, FIG. 9. The downstream support roll 102 is, similarly to the upstream support roll 92, capable of contacting the steel sheet 12 and separating from the steel sheet 12.

FIG. 8 illustrates a contact state in which the upstream support roll 92 and the downstream support roll 102 contact the steel sheet 12. FIG. 9 illustrates a separated state in which the upstream support roll 92 and the downstream support roll 102 are separated from the steel sheet 12. FIG. 10 illustrates a separated state in which the upstream support roll 92 is separated from the steel sheet 12.

As illustrated in FIG. 10, the intermediate sealing devices 56 each include a drive mechanism 114. The drive mechanism 114 illustrated in FIG. 10 is a drive mechanism to cause the upstream support roll 92 to contact the steel sheet 12 or to separate from the steel sheet 12, and is provided outside the furnace body 14. The drive mechanism 114 includes a motor 116, a drive shaft 118, a pair of driven shafts 120, a pair of drive gears 122, and a pair of driven gears 124, a pair of sliders 126, and a pair of bellows 128.

The drive shaft 118 is connected to the output shaft of the motor 116, and is disposed parallel to the rotation shaft 100. The drive gears 122 are each fixed to the respective two ends of the drive shaft 118. The pair of driven shafts 120 extend in a direction orthogonal to the rotation shaft 100 in plan view. The driven gears 124 are respectively fixed to one end of the pair of respective driven shafts 120, and the driven gears 124 respectively mesh with the drive gears 122. The driven shafts 120 and the sliders 126 configure a ball screw mechanism. The two ends of the rotation shaft 100 are respectively fixed to the pair of sliders 126.

In the drive mechanism 114, the sliders 126 perform a reciprocating movement as the output shaft of the motor 116 rotates in a forward direction or reverse direction, and the upstream support roll 92 contacts the steel sheet 12 or separates from the steel sheet 12. The pair of bellows 128 are, for example, formed from a material having a high ability to withstand heat, such as a silicone rubber. Peripheral edge portions of the guide holes 112 and the sliders 126 are respectively connected by the bellows 128, such that the guide holes 112 are sealed by the bellows 128.

In each of the intermediate sealing devices 56, a drive mechanism 154, which is similar to the drive mechanism 114 illustrated in FIG. 10, is provided to the downstream support roll 102 illustrated in FIG. 8 and FIG. 9. The downstream support roll 102 contacts the steel sheet 12 or separates from the steel sheet 12 by the drive mechanism 154. The upstream support roll 92 and the downstream support roll 102 are each supported in a state of contact with the steel sheet 12, so as to contact the steel sheet 12 from one side and the other side in the sheet thickness direction of the steel sheet 12.

As illustrated in FIG. 8 and FIG. 9, the upstream first seal 94 is disposed at the opposite side of the upstream support roll 92 to the steel sheet 12, and extends from an inner wall of the furnace body 14 toward the upstream support roll 92. The upstream second seal 96 is disposed at the opposite side of the steel sheet 12 to the upstream support roll 92, and extends from the inner wall of the furnace body 14 toward the steel sheet 12. The end of the upstream second seal 96 on the steel sheet 12 side is in proximity to the steel sheet 12. There is a gap to present between the upstream first seal 94 and the upstream second seal 96 to let the steel sheet 12 pass through, and a gap is secured to move the upstream support roll 92 in directions to contact the steel sheet 12 or separate from the steel sheet 12.

As illustrated in FIG. 10, the upstream roll seal 98 is fixed to the rotation shaft 100, and moves as a unit together with the rotation shaft 100 and the upstream support roll 92. A recess 130 is formed in the upstream roll seal 98 to accommodate the upstream support roll 92. As illustrated in FIG. 8, in a state of contact of the upstream support roll 92 with the steel sheet 12, the gap between the upstream first seal 94 and the steel sheet 12 is closed by the upstream support roll 92 and the upstream roll seal 98. The end of the upstream roll seal 98 on the upstream first seal 94 side overlaps with the end of the upstream first seal 94 on the upstream roll seal 98 side.

The downstream support roll 102, the downstream first seal 104, the downstream second seal 106, and the downstream roll seal 108 illustrated in FIG. 8 and FIG. 9 are arranged in the opposite sequence to the upstream support roll 92, the upstream first seal 94, the upstream second seal 96, and the upstream roll seal 98 described above.

The downstream first seal 104 is disposed at the opposite side of the downstream support roll 102 to the steel sheet 12, and extends from the inner wall of the furnace body 14 toward the downstream support roll 102. Moreover, the downstream second seal 106 is disposed at the opposite side of the steel sheet 12 to the downstream support roll 102, and extends from the inner wall of the furnace body 14 toward the steel sheet 12. An end of the downstream second seal 106 on the steel sheet 12 side is in proximity to the steel sheet 12. A gap is present between the downstream first seal 104 and the downstream second seal 106 to let the steel sheet 12 pass through, and a gap is secured to move the downstream support roll 102 in directions to contact the steel sheet 12 or separate from the steel sheet 12.

Moreover, similarly to the upstream roll seal 98, the downstream roll seal 108 is fixed to a rotation shaft 110, and moves as a unit together with the downstream support roll 102. As illustrated in FIG. 9, in a state of contact of the downstream support roll 102 with the steel sheet 12, the gap between the downstream first seal 104 and the steel sheet 12 is closed by the downstream support roll 102 and the downstream roll seal 108. The end of the downstream roll seal 108 on the downstream first seal 104 side overlaps with the end of the downstream first seal 104 on the downstream roll seal 108 side.

Note that, as illustrated in FIG. 2, plural support rolls 131, 132 are provided in the down-pass space 28 to support the steel sheet 12 in the sheet thickness direction of the steel sheet 12. The support roll 131 is disposed at an upper portion of the down-pass space 28, and the support roll 132 is disposed at a lower portion of the down-pass space 28. The upstream support roll 92, the downstream support roll 102, and the plural support rolls 131, 132 provided in each of the intermediate sealing devices 56 perform the function of suppressing fluttering of the steel sheet 12 by contacting the steel sheet 12.

Explanation follows regarding a cooling method in the continuous annealing furnace employing the cooling equipment 50 according to the first exemplary embodiment of the present invention. The cooling method in the continuous annealing furnace includes, as described below, a sealing step, and a cooling gas injection step.

Sealing Step

In the sealing step, the plural intermediate sealing devices 56 are actuated to perform sealing. Namely, the motor 116 illustrated in FIG. 10 is actuated, and the drive force of the motor 116 is transmitted to the pair of sliders 126 through the drive shaft 118, the pair of drive gears 122, the pair of driven gears 124, and the pair of driven shafts 120. The upstream support roll 92 is then, together with the pair of sliders 126, moved so as to approach the steel sheet 12, and, as illustrated in FIG. 8, the upstream support roll 92 is placed in a state of contact with the steel sheet 12. In the state of contact of the upstream support roll 92 with the steel sheet 12, the gap between the upstream first seal 94 and the steel sheet 12 is closed by the upstream support roll 92 and the upstream roll seal 98.

Similarly, the drive mechanism 154 provided to the downstream support roll 102 illustrated in FIG. 9 is actuated, and the downstream support roll 102 is placed in a state of contact with the steel sheet 12. In the state of contact of the downstream support roll 102 with the steel sheet 12, the gap between the downstream first seal 104 and the steel sheet 12 is closed by the downstream support roll 102 and the downstream roll seal 108.

The plural intermediate sealing devices 56 respectively seal between the pair of injection devices 52A and the pair of injection devices 52B, the pair of injection devices 52B and the pair of injection devices 52C, and the pair of injection devices 52C and the pair of injection devices 52D illustrated in FIG. 2. The upstream support roll 92 and the downstream support roll 102 support the steel sheet 12 from both sheet thickness direction sides while rotating in contact with the steel sheet 12 passing through the down-pass space 28.

Cooling Gas Injection Step

Figure 7:
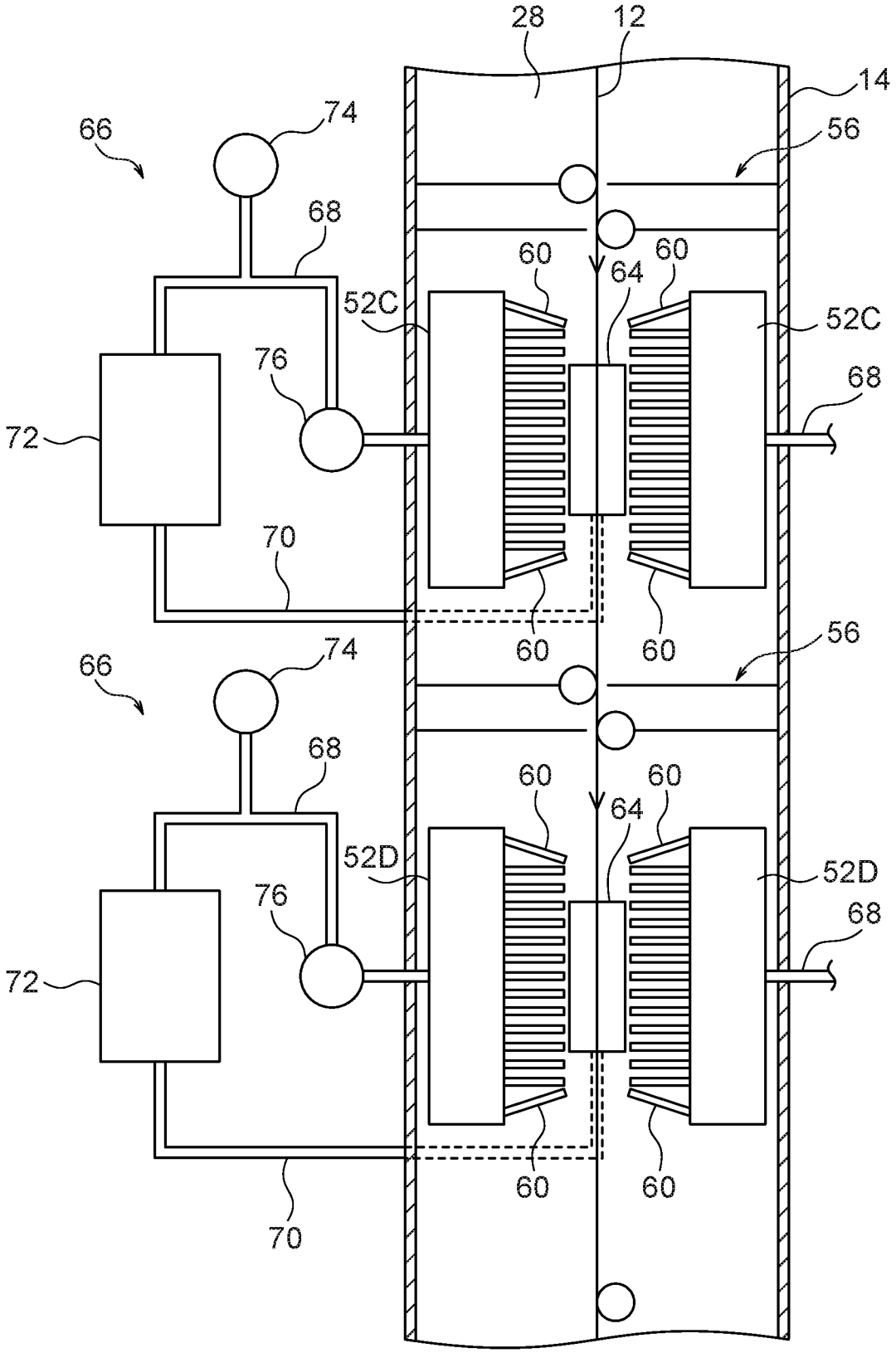
FIG. 7 is a face-on view including a partial cross-section of peripheral portions of a downstream injection device of FIG. 4.

Then in the cooling gas injection step, the respective blowers 76 illustrated in FIG. 6 and FIG. 7 are actuated, and cooling gas is injected onto the steel sheet 12 from the plural injection devices 52A to 52D. When this is performed, in order to raise the steel sheet 12 cooling performance, the cooling gas from the plural injection devices 52A to 52D is injected (by jet injection) at a maximum flow speed.

Moreover, when the cooling gas is injected from the plural injection devices 52A to 52D, the hydrogen supply sources 74 illustrated in FIG. 6 and FIG. 7 are actuated, and respectively supply hydrogen into the out-path pipes 68. The cooling gases injected from the plural injection devices 52A to 52D are accordingly all cooling gases with added hydrogen.

Moreover, the hydrogen supply sources 74 of the upstream circulation systems 66 illustrated in FIG. 6 supply more hydrogen into the respective out-path pipes 68 than the hydrogen supply sources 74 of the downstream circulation systems 66 illustrated in FIG. 7. Thus, the cooling gas injected from the plural upstream injection devices 52A, 52B has a higher hydrogen concentration than the cooling gas injected from the plural downstream injection devices 52C, 52D. A hydrogen concentration distribution is accordingly formed in the down-pass space 28 in which an upstream region where the plural injection devices 52A, 52B are disposed has a higher hydrogen concentration than a downstream region where the plural injection devices 52C, 52D are disposed.

Thereby, for example, in comparison to cases in which the cooling gases with the same hydrogen concentration are injected from the plural injection devices 52A to 52D and the hydrogen concentration distribution is constant, the speed of cooling after soaking the steel sheet 12, namely, the speed of cooling from starting cooling the steel sheet 12 in the cooling zone 20, is raised, and the steel sheet 12 may be cooled rapidly from a higher temperature state. In the present exemplary embodiment, at least one of the hydrogen concentration or flow rate is adjusted for the cooling gas injected from the plural upstream injection devices 52A, 52B so as to obtain the desired speed of cooling.

Note that the injection devices 52A and the injection devices 52B may have the same hydrogen concentration in the cooling gas for injection as each other, or the hydrogen concentration in cooling gas for injection by the upstream injection devices 52A may be higher than that for the injection devices 52B. Similarly, the injection devices 52C and the injection devices 52D may have the same hydrogen concentration in the cooling gas for injection as each other, or the hydrogen concentration in cooling gas for injection by the injection devices 52C may be higher than that for the injection devices 52D.

In cases in which the hydrogen concentration in cooling gas for injection by the injection devices 52A is higher than that for the injection devices 52B, and the hydrogen concentration in cooling gas for injection by the injection devices 52C is higher than for the injection devices 52D, a hydrogen concentration distribution is formed in which the hydrogen concentration rises in sequence from a region where the injection devices 52D are disposed, through a region where the injection devices 52C are disposed and a region where the injection devices 52B are disposed, to a region where the injection devices 52A are disposed. In the present exemplary embodiment, as an example, the hydrogen concentration in the cooling gas that is injected from the plural injection devices 52A to 52D is adjusted in this manner so as to rise in sequence from the downstream injection devices 52D to the upstream injection devices 52A.

Moreover, as illustrated in FIG. 6, from out of the plural injection nozzles 60 in each of the injection devices 52, the injection nozzles 60 that are positioned at both up-down direction sides of the injection devices 52 are inclined so as to slope toward the center in the up-down direction of the injection devices 52 on progression toward the tips of the injection nozzles 60. Thus cooling gas is injected from the injection nozzles 60 at both sides toward the center in the up-down direction of the injection devices 52. The cooling gas injected from the injection nozzles 60 at both sides and hitting the steel sheet 12 is accordingly suppressed from spreading out up and down the injection devices 52.

However, in each of the injection devices 52, the remaining plural injection nozzles 60, other than the injection nozzles 60 positioned at both sides from out of the plural injection nozzles 60, extend in normal directions towards sheet faces of the steel sheet 12. Thus the cooling gas injected from the remaining injection nozzles 60 is injected in normal directions towards sheet faces of the steel sheet 12. Thereby, the cooling gas injected from the remaining injection nozzles 60 is injected toward the steel sheet 12 at a minimum distance, and the cooling gas hits the steel sheet 12 perpendicularly. The steel sheet 12 is accordingly cooled with good efficiency.

The cooling gas injected from each of the injection devices 52 is then sucked in through the air intake port 64 and cooled in the heat exchanger 72. Hydrogen supplied from the hydrogen supply source 74 is added to the cooling gas cooled in the heat exchanger 72. The cooling gas supplied through the blower 76 to the injection devices 52 is injected from the injection devices 52. The cooling gas injected from the injection devices 52 has a flow rate of hydrogen supplied from the hydrogen supply source 74 adjusted so as to maintain a desired hydrogen concentration using flow rate adjustment valves or the like.

Note that the cooling gas that is injected from the injection devices 52D downstream is set with a lower hydrogen concentration than the cooling gas that is injected from the other plural injection devices 52A, 52B, 52C. Therefore, in the region where the downstream injection devices 52D are disposed, the steel sheet 12 is cooled more gently than in regions where the other plural injection devices 52A, 52B, 52C are disposed.

The rapid cooling final temperature of the steel sheet 12 is important for securing the strength of the steel sheet 12, as described in, for example, Japanese Patent Application 2004-375756 (Japanese Patent Application Laid-Open (JP-A) No. 2006-183075) and "Steel Times International—January/February 2011 Flash Cooling technology for the production of high strength galvanised steels".

In the present exemplary embodiment, at least one of the hydrogen concentration or flow rate is adjusted in the cooling gas that is injected from the downstream injection devices 52D by being adjusted such that the steel sheet 12 achieves the desired rapid cooling final temperature. In the present exemplary embodiment, the steel sheet 12 is cooled by the scheme described above.

Now explanation follows regarding the operation and advantageous effects of the first exemplary embodiment of the present invention.

Figure 20:
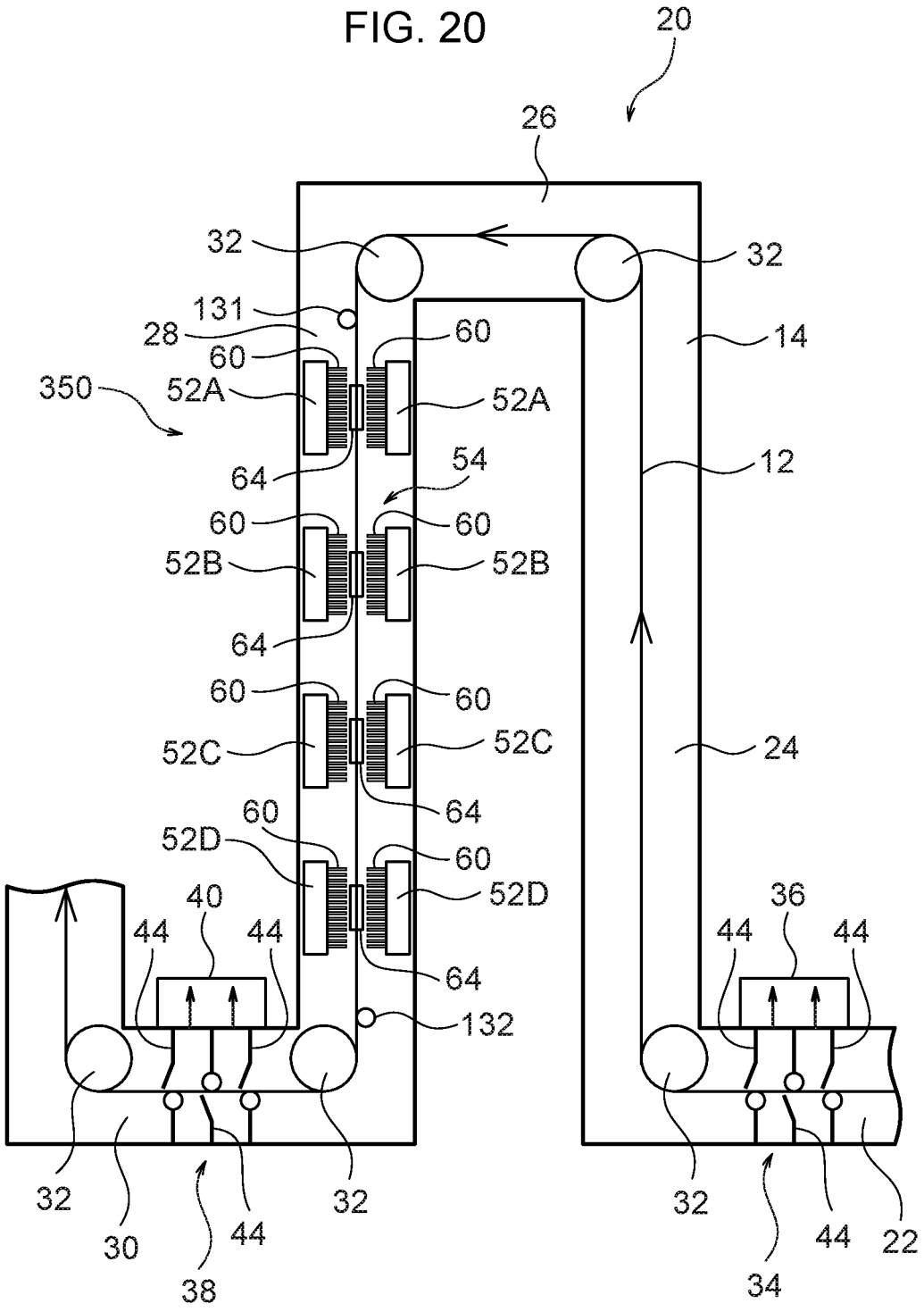
FIG. 20 is a face-on view illustrating a cooling zone where cooling equipment according to a comparative example is applied.

First, explanation follows regarding a comparative example to clarify the operation and advantageous effects of the first exemplary embodiment of the present invention. Cooling equipment 350 according to the comparative example is illustrated in FIG. 20, and configuration is described below that differs from that of the above cooling equipment 50 according to the first exemplary embodiment of the present invention.

Namely, in the cooling equipment 350 according to the comparative example, the cooling gas is injected at the same concentration from plural injection devices 52A to 52D. Moreover, in the cooling equipment 350 according to the comparative example, due to the cooling gas being injected at the same concentration from the plural injection devices 52A to 52D, the hydrogen concentration distribution of a down-pass space 28 is constant in the up-down direction, and so the plural intermediate sealing devices 56 (see FIG. 2) are not required. The plural intermediate sealing devices 56 are accordingly omitted from the cooling equipment 350 according to the comparative example.

Moreover, in order to raise the steel sheet 12 cooling performance, each of plural injection nozzles 60 in the plural injection devices 52A to 52D extends in normal direction towards sheet faces of the steel sheet 12 so that the cooling gas hits the steel sheet 12 perpendicularly, namely, with the shortest distance. Moreover, in order to raise the steel sheet 12 cooling performance, the cooling gas is injected (by jet injection) at a maximum flow speed from the plural injection devices 52A to 52D.

In relation to the speed of cooling required for manufacturing the steel sheet 12, as is apparent from the logarithmic scale of a horizontal axis of a time-temperature-transformation (TTT) diagram, rapid cooling of the steel sheet 12 in higher temperature regions of the steel sheet 12 is known to enable a reduction in the addition amounts of alloys. Accordingly, the higher the speed of cooling after soaking the steel sheet 12, namely, the higher the speed of cooling from starting to cool the steel sheet 12 in the cooling zone 20, the higher the strength obtained for a small alloy amount.

Thus in the cooling equipment 350 according to the comparative example, for example, in cases in which the hydrogen concentration in the cooling gas that is injected from the plural injection devices 52A to 52D is set the same as the hydrogen concentration in the cooling gas that is injected from the furthest upstream injection devices 52A in the cooling equipment 50 of the first exemplary embodiment of the present invention, although the speed of cooling from starting cooling the steel sheet 12 in the cooling zone 20 can be raised, the amount of hydrogen used is increased, which increases the manufacturing cost of the steel sheet 12.

However, in the cooling equipment 350 according to the comparative example, for example, consider a case in which the hydrogen concentration in the cooling gas that is injected from the plural injection devices 52A to 52D is set the same as the hydrogen concentration in the cooling gas that is injected from the furthest downstream injection devices 52D in the cooling equipment 50 of the first exemplary embodiment of the present invention. In such a case, although the amount of hydrogen used, and therefore the manufacturing cost of the steel sheet 12, can be reduced, the speed of cooling from starting cooling the steel sheet 12 in the cooling zone 20 falls, and so the amount of alloy in the steel sheet 12 increases and there is a fall in the strength of the steel sheet 12.

Thus, in order to achieve both a higher quality and to reduce costs for the steel sheet 12, it is desirable to be able to reduce the amount of hydrogen used while still raising the speed of cooling from starting cooling the steel sheet 12 in the cooling zone 20.

In relation to this point, in the cooling equipment 50 according to the first exemplary embodiment of the present invention illustrated in FIG. 2, as an example, the hydrogen concentration in the cooling gas that is injected from the plural injection devices 52A to 52D rises in sequence from the downstream injection devices 52D to the upstream injection devices 52A. A hydrogen concentration distribution is accordingly formed in which the hydrogen concentration rises in sequence from the region where the injection devices 52D are disposed, through the region where the injection devices 52C are disposed and the region where the injection devices 52B are disposed, to the region where the injection devices 52A are disposed.

Thus, the speed of cooling after soaking the steel sheet 12, namely the speed of cooling from starting cooling the steel sheet 12 in the cooling zone 20 can be raised, and the steel sheet 12 can be cooled rapidly from a higher temperature state. This enables, for example, a high strength to be obtained even when the amounts of alloy such as silicon (Si) and manganese (Mn) are suppressed to small amounts.

Moreover, the hydrogen concentration in the cooling gas that is injected from the plural injection devices 52A to 52D falls in sequence from the upstream injection devices 52A to the downstream injection devices 52D. This enables a reduction in the amount of hydrogen used.

In the cooling equipment 350 according to the comparative example illustrated in FIG. 20, one might, for example, consider making the hydrogen concentration in the cooling gas that is injected from the plural injection devices 52A to 52D rise in sequence from the downstream injection devices 52D to the upstream injection devices 52A, similarly to in the first exemplary embodiment described above.

However, in the cooling equipment 350 according to the comparative example, all of the plural injection nozzles 60 in the plural injection devices 52A to 52D extend in normal directions towards sheet faces of the steel sheet 12. Making the distance in the injection direction from the tips of the injection nozzles 60 to the steel sheet 12 shorter enables the steel sheet 12 cooling performance to be raised. However, if the tips of the injection nozzles 60 are too close to the steel sheet 12, then when a steel sheet 12 that has lost its shape passes, or when the steel sheet 12 vibrates, the tips of the injection nozzles 60 would contact the steel sheet 12, damaging the injection nozzles 60 and marking the steel sheet 12. It is accordingly common practice by a person of skill in the art to set the gap between the steel sheet 12 and the injection nozzles 60 at the minimum distance to enable sheets to pass, and to extend the injection nozzles 60 in normal directions towards sheet faces of the steel sheet 12.

Therefore, for example, cooling gas with a high hydrogen concentration injected from the upstream injection devices 52A hits the steel sheet 12 and flows into another region having a lower hydrogen concentration. Moreover, in the air intake port 64 corresponding to the upstream injection devices 52A, cooling gas with a lower hydrogen concentration that has been injected from the injection devices 52B positioned downstream thereof, and gas not containing hydrogen from positions upstream of the injection devices 52A, such as the intermediate-pass space 26, mixes in and is sucked in. This means injection of cooling gas at high hydrogen concentration from the upstream injection devices 52A is no longer possible.

Moreover, if an attempt were made to secure the hydrogen concentration in the cooling gas that is injected from the upstream injection devices 52A, then hydrogen would need to be added to the cooling gas that is injected from the upstream injection devices 52A, increasing the manufacturing cost of the steel sheet 12.

Moreover, in the downstream injection devices 52D as well, cooling gas with a high hydrogen concentration, which has been injected from the injection devices 52C etc. that are positioned upstream of the air intake port 64 corresponding to the downstream injection devices 52D, is mixed in and sucked into the air intake port 64. This means that hydrogen concentration of the cooling gas that is injected from the downstream injection devices 52D is raised, so that the predetermined hydrogen concentration is no longer obtainable.

In relation to this point, in the cooling equipment 50 according to the first exemplary embodiment of the present invention illustrated in FIG. 2, from out of the plural injection nozzles 60 in each of the injection devices 52, the injection nozzles 60 positioned at both up-down direction sides of the injection devices 52 are, as illustrated in FIG. 5, inclined so as to slope toward the center in the up-down direction of the injection devices 52 on progression toward the tips of the injection nozzles 60. The cooling gas injected from these injection nozzles 60 at both sides is injected toward the center in the up-down direction of the injection devices 52. This enables the cooling gas injected from the injection nozzles 60 at both sides that hits the steel sheet 12 to be suppressed from spreading up and down the injection devices 52.

Thereby, as illustrated in FIG. 4, a hydrogen concentration distribution can be maintained in which the hydrogen concentration rises in sequence from the region where the injection devices 52D are disposed, through the region where the injection devices 52C are disposed and the region where the injection devices 52B are disposed, to the region where the injection devices 52A are disposed. This also enables the amount of hydrogen used to be reduced even further. In particular, maintaining a hydrogen concentration distribution having a high hydrogen concentration at the uppermost stage of the injection devices 52A, where rapid cooling is desired, more than compensates for a drop in cooling performance due to increasing the injection distance from the tips of the injection nozzles 60 to the steel sheet 12 from inclining the injection nozzles 60. This enables a high cooling performance to be secured.

Moreover, as illustrated in FIG. 5, the remaining plural injection nozzles 60 in each of the injection devices 52, other than the injection nozzles 60 positioned at both sides from out of the plural injection nozzles 60, extend in normal directions towards sheet faces of the steel sheet 12. Thus cooling gas is injected from these remaining injection nozzles 60 in normal directions towards sheet faces of the steel sheet 12. Thereby, the cooling gas is injected at the shortest distance from the remaining injection nozzles 60 to the steel sheet 12, and, this cooling gas hits the steel sheet 12 perpendicularly. This enables the steel sheet 12 to be cooled with good efficiency, and enables the steel sheet 12 cooling performance to be raised.

Moreover, the air intake ports 64 are disposed between the injection nozzles 60 positioned at both up-down direction sides of each of the injection devices 52. Thus cooling gas injected from the plural injection nozzles 60 is sucked into the air intake ports 64 without diffusing, enabling the cooling gas to be recovered with good efficiency by the air intake port 64.

Moreover, as illustrated in FIG. 4, the intermediate sealing devices 56 respectively seal between the pair of injection devices 52A and the pair of injection devices 52B, the pair of injection devices 52B and the pair of injection devices 52C, and the pair of injection devices 52C and the pair of injection devices 52D. Thus an appropriate hydrogen concentration distribution can be maintained due to being able to suppress cooling gas from flowing out from one region to another region for regions positioned on the two sides of each of the intermediate sealing devices 56.

Moreover, as illustrated in FIG. 8 and FIG. 9, each of the intermediate sealing devices 56 has a double-seal structure configured by the upstream seal section 88 and the downstream seal section 90. This enables the sealing ability of the intermediate sealing devices 56 to be raised.

Moreover, in the intermediate sealing devices 56, the upstream support roll 92, the upstream first seal 94, the upstream second seal 96, and the upstream roll seal 98 are arranged in the opposite sequence to the downstream support roll 102, the downstream first seal 104, the downstream second seal 106, and the downstream roll seal 108.

This enables a gap 142 between the steel sheet 12 and the upstream second seal 96 to be closed by the downstream support roll 102, the downstream first seal 104, and the downstream roll seal 108. Similarly, a gap 144 between the steel sheet 12 and the downstream second seal 106 can be closed by the upstream support roll 92, the upstream first seal 94, and the upstream roll seal 98. This enables the sealing ability of the intermediate sealing devices 56 to be raised even further.

Moreover, as illustrated in FIG. 2, the plural injection devices 52A to 52D and the plural intermediate sealing devices 56 are disposed in the down-pass space 28, and the plural injection devices 52A are disposed in an upper portion of the down-pass space 28. Thus, due to upward movement of the hydrogen that has a low specific gravity through gaps and the like in the intermediate sealing devices 56, a concentration gradient is formed such that in the regions where the plural injection devices 52A are disposed, the hydrogen concentration is higher further upstream. The steel sheet 12 is thereby rapidly cooled immediately after being fed into the down-pass space 28, enabling the speed of cooling from starting cooling the steel sheet 12 in the cooling zone 20 to be raised even further.

Moreover, the cooling gas that is injected from the downstream injection devices 52D is set with a lower hydrogen concentration than the cooling gas that is injected from the other plural injection devices 52A, 52B, 52C. Thus more gentle cooling of the steel sheet 12 can be performed in the region where the downstream injection devices 52D are disposed than in the regions where the other plural injection devices 52A, 52B, 52C are disposed. This facilitates adjustments to the temperature of the steel sheet 12, and so enables the controllability to be improved for the rapid cooling final temperature, which is important for the strength of the steel sheet 12.

Explanation follows regarding a modified example of the first exemplary embodiment of the present invention.

In the first exemplary embodiment, the remaining plural injection nozzles 60 in each of the injection devices 52, other than the injection nozzles 60 positioned at both up-down direction sides of the injection devices 52 from out of the plural injection nozzles 60, extend in normal directions towards sheet faces of the steel sheet 12.

Figure 11:
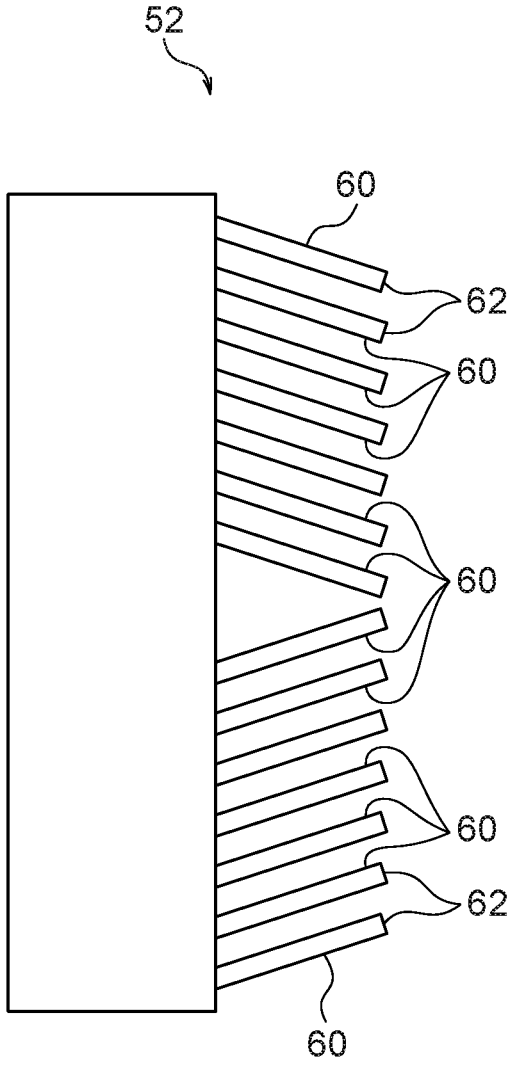
FIG. 11 is a side view illustrating a first modified example of an injection device of FIG. 5.

However, for example, as illustrated in FIG. 11, in the injection devices 52, the plural injection nozzles 60 positioned at the upper side of the up-down direction center portion of the injection devices 52 from out of the plural injection nozzles 60 may be inclined so as to slope downward in the up-down direction of the injection devices 52 on progression toward the tip of the injection nozzles 60. Moreover, the plural injection nozzles 60 positioned at the lower side of the up-down direction center portion of the injection devices 52 from out of the plural injection nozzles 60 may be inclined so as to slope upward in the up-down direction of the injection devices 52 on progression toward the tips of the injection nozzles 60. Namely, in each of the injection devices 52, all of the plural injection nozzles 60 may be inclined.

Adopting such a configuration enables the cooling gas injected from each of the injection devices 52 to be even further suppressed from spreading out in the up-down direction of the injection devices 52.

Figure 12:
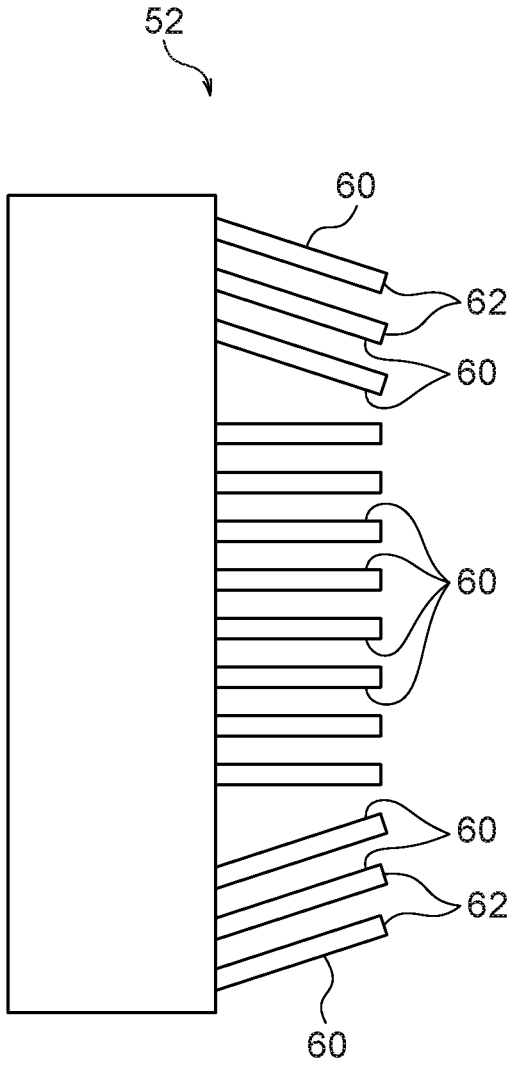
FIG. 12 is a side view illustrating a second modified example of an injection device of FIG. 5.

Moreover, for example, as illustrated in FIG. 12, plural inclined injection nozzles 60 may be provided at both up-down direction sides of each of the injection devices 52. Namely, plural inclined injection nozzles 60 may be provided on each of the two up-down direction sides of the injection devices 52.

Adopting such a configuration enables the cooling gas injected from the injection devices 52 to be suppressed from spreading in the up-down direction of the injection devices 52 by an amount commensurate with the increased number of inclined injection nozzles 60. However, in consideration that inclining the injection nozzles 60 lengthens the path of cooling gas injected from these inclined injection nozzles 60 to the steel sheet 12 and lowers the steel sheet 12 cooling performance, the number of inclined injection nozzles 60 is preferably set within a range that enables the steel sheet 12 cooling performance to be secured.

Figure 13:
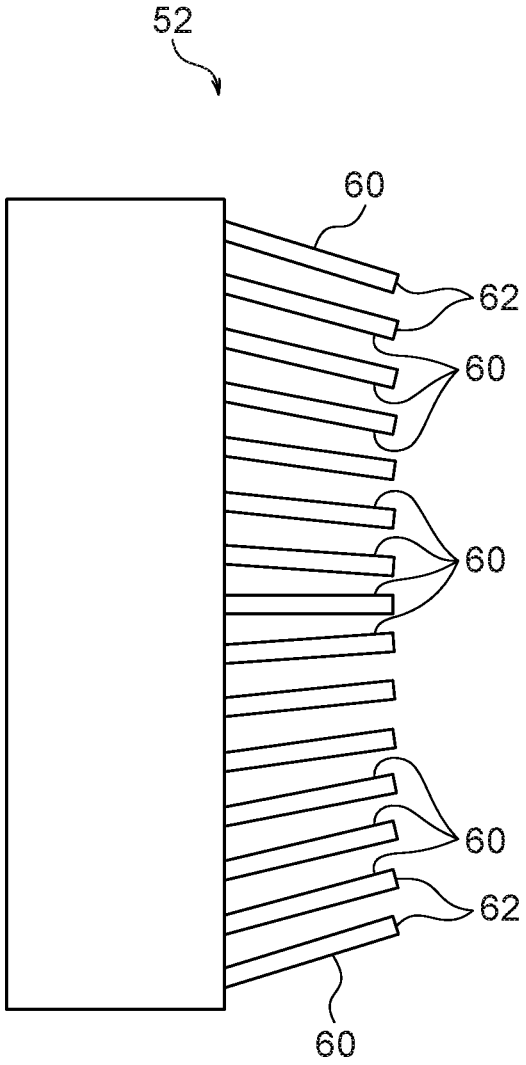
FIG. 13 is a side view illustrating a third modified example of an injection device of FIG. 5.

Moreover, for example, a configuration may be adopted as illustrated in FIG. 13 in which, from out of the plural injection nozzles 60 in each of the injection devices 52, the plural injection nozzles 60 positioned at the upper side of the up-down direction center portion of the injection devices 52 have an inclination angle that is progressively smaller from the injection nozzles 60 on the upper side to the injection nozzles 60 on the lower side. Moreover, a configuration may be adopted in which, from out of the plural injection nozzles 60, the plural injection nozzles 60 positioned at the lower side of the up-down direction center portion of the injection devices 52 have an inclination angle that is progressively smaller from the injection nozzles 60 on the lower side to the injection nozzles 60 on the upper side.

In such a configuration as well, the cooling gas injected from each of the injection devices 52 is also suppresses from spreading out in the up-down direction of the injection devices 52, while also enabling the steel sheet 12 cooling performance to be secured by the cooling gas injected from the injection devices 52.

Moreover, in the first exemplary embodiment, the plural upstream injection devices 52A, 52B are configured the same as the plural downstream injection devices 52C, 52D. The arrangement of the plural injection nozzles 60, and the number of inclined injection nozzles 60 etc. are the same in the plural upstream injection devices 52A, 52B and the plural downstream injection devices 52C, 52D.

However, the arrangement of the plural injection nozzles 60 and the number of inclined injection nozzles 60 etc. may be different in the plural upstream injection devices 52A, 52B to in the plural downstream injection devices 52C, 52D. Moreover, the arrangement of the plural injection nozzles 60 and the number of inclined injection nozzles 60 etc. may be different in the injection devices 52A to in the injection devices 52B. Similarly, the arrangement of the plural injection nozzles 60 and the number of inclined injection nozzles 60 etc. may be different in the injection devices 52C to in the injection devices 52D.

Moreover, although in the first exemplary embodiment, the cooling equipment 50 included the four stages of the plural injection devices 52A to 52D, any number of stages may be employed for the plural injection devices.

Moreover, although in the first exemplary embodiment each of the intermediate sealing devices 56 had a double structure including the upstream seal section 88 and the downstream seal section 90, each of the intermediate sealing devices 56 may have a single or triple structure.

Moreover, although each of the intermediate sealing devices 56 are configured by the upstream support roll 92, the upstream first seal 94, the upstream second seal 96, the upstream roll seal 98, the downstream support roll 102, the downstream first seal 104, the downstream second seal 106, and the downstream roll seal 108, a configuration including other members may be adopted.

Figure 14:
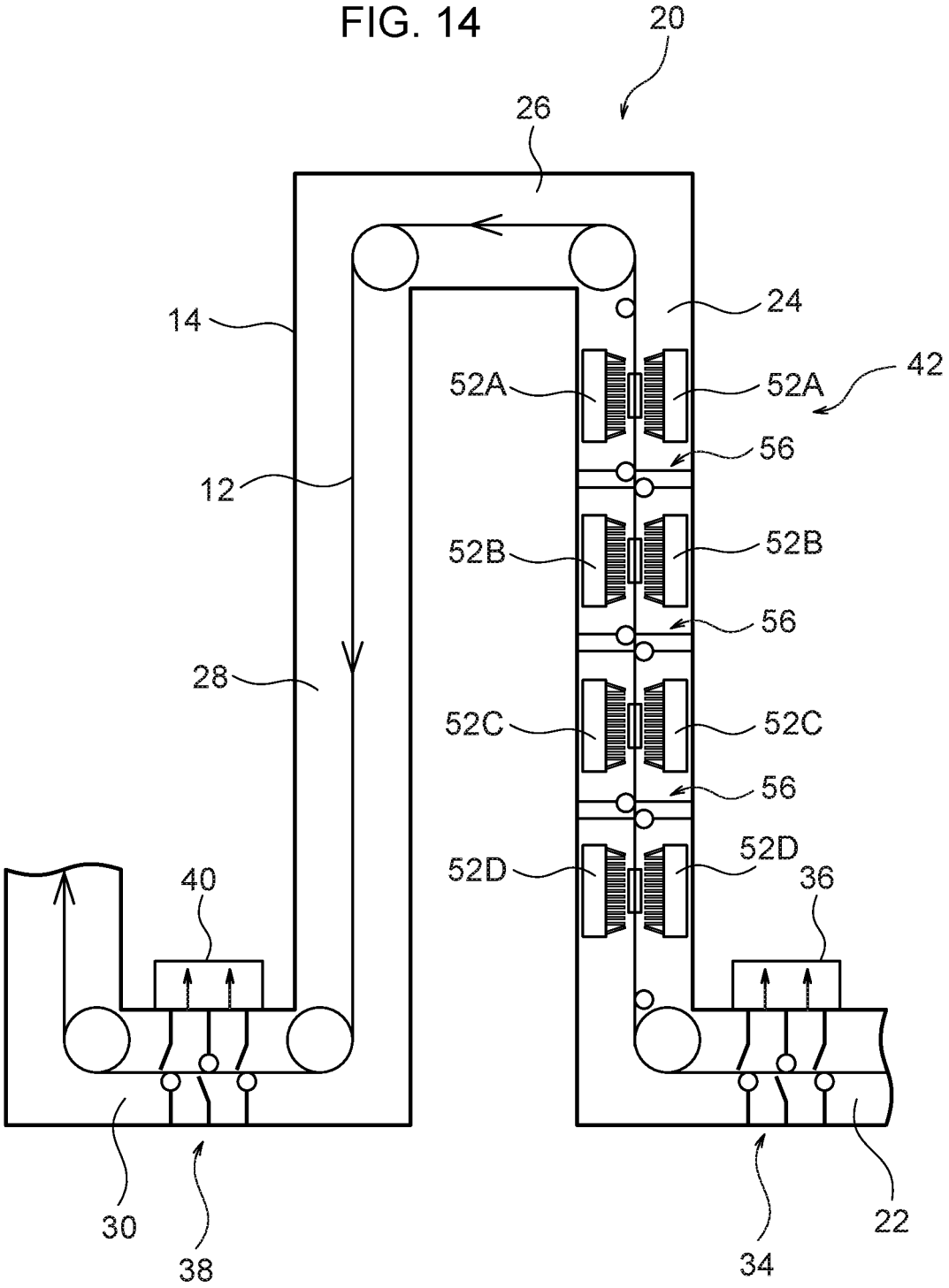
FIG. 14 is a face-on view illustrating a modified example of the cooling equipment of FIG. 2.

Moreover, in the first exemplary embodiment, the plural injection devices 52A to 52D and the plural intermediate sealing devices 56 were disposed in the down-pass space 28. However, for example, in cases in which the steel sheet 12 needs to be cooled in the up-pass space 24 due to equipment circumstances, the plural injection devices 52A to 52D and the plural intermediate sealing devices 56 may be disposed in the up-pass space 24, as illustrated in FIG. 14.

Moreover, the plural injection devices 52A to 52D and the plural intermediate sealing devices 56 may be disposed in a space other than the down-pass space 28 and the up-pass space 24.

Moreover, although in the first exemplary embodiment the cooling equipment 50 includes the plural intermediate sealing devices 56, any of the intermediate sealing devices 56 may be omitted from out of the plural intermediate sealing devices 56. Moreover, all of the intermediate sealing devices 56 may be omitted from the cooling equipment 50.

Moreover, in the first exemplary embodiment the circulation systems 66 are provide for each of the respective pairs of injection devices 52A to 52D, which are respective pairs of injection devices arranged facing each other across the steel sheet 12. However, from out of the plural injection devices 52A to 52D, in cases in which the hydrogen concentration in the cooling gas is the same for injection devices that are arranged in a row along the feed direction of the steel sheet 12, a common circulation systems 66 may be provided for these injection devices arranged in a row along the feed direction of the steel sheet 12.

Second Exemplary Embodiment

Next, explanation follows regarding the second exemplary embodiment of the present invention.

Figure 15:
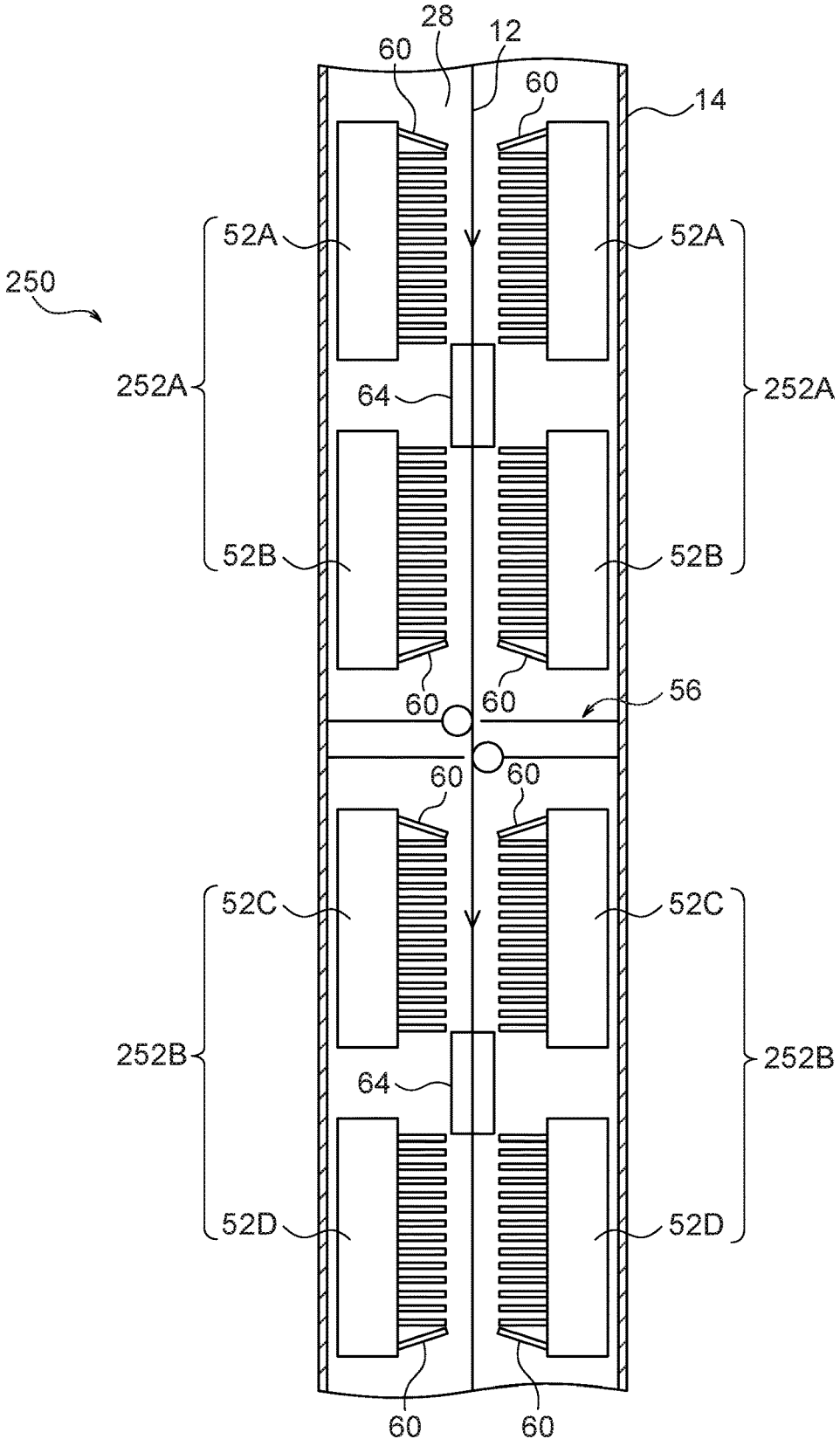
FIG. 15 is a face-on view including a partial cross-section of peripheral portions of plural injection devices in a cooling zone where cooling equipment according to a second exemplary embodiment of the present invention is applied.

FIG. 15 illustrates a cooling equipment 250 according to a second exemplary embodiment of the present invention. The cooling equipment 250 has the following differences in configuration from the cooling equipment 50 of the first exemplary embodiment (see FIG. 4).

Namely, in the cooling equipment 250 according to the second exemplary embodiment of the present invention, the intermediate sealing device 56 between the pair of injection devices 52A and the pair of injection devices 52B, and the intermediate sealing device 56 between the pair of injection devices 52C and pair of injection devices 52D, are omitted. Only the intermediate sealing device 56 is disposed between the pair of the injection devices 52B and the pair of the injection devices 52C.

Injection units 252A are each configured by the injection devices 52A, 52B arranged in a row along the feed direction of the steel sheet 12, and injection units 252B are each configured by the injection devices 52C, 52D arranged in a row along the feed direction of the steel sheet 12. The plural injection units 252A, 252B have the same configuration as each other. Note that when collectively describing the plural injection units 252A, 252B, the plural injection units 252A, 252B are simply referred to below as the injection units 252.

The injection units 252A each include plural injection nozzles 60 allocated between the injection devices 52A, 52B arranged in a row along the feed direction of the steel sheet 12. Namely, the plural injection nozzles 60 of each of the injection units 252A are configured by plural injection nozzles 60 provided to the injection device 52A, and plural injection nozzles 60 provided to the injection device 52B.

From out of the plural injection nozzles 60 in each of the injection units 252A, the injection nozzles 60 that are positioned at both up-down direction sides of the injection units 252A, namely, the injection nozzles 60 at the upper side of the injection devices 52A, and the injection nozzles 60 at the lower side of the injection devices 52B, are inclined so as to slope toward the up-down direction center of the respective injection units 252A on progression toward the tips of the injection nozzles 60.

However, from out of the plural injection nozzles 60 in each of the injection units 252A, the remaining plural injection nozzles 60 other than the injection nozzles 60 positioned at both up-down direction sides of each of the injection units 252A, extend in the front-rear direction of the injection units 252A, namely, extend in normal directions towards sheet faces of the steel sheet 12.

Similarly, the injection units 252B each include plural injection nozzles 60 allocated between the injection devices 52C, 52D arranged in a row along the feed direction of the steel sheet 12. Namely, the plural injection nozzles 60 of the injection units 252B are configured by plural injection nozzles 60 provided to the injection devices 52C, and plural injection nozzles 60 provided to the injection devices 52D.

From out of the plural injection nozzles 60 in the respective injection units 252B, the injection nozzles 60 that are positioned at both up-down direction sides of the injection units 252B, namely, the injection nozzles 60 at the upper side of the injection devices 52C, and the injection nozzles 60 at the lower side of the injection devices 52D, are inclined so as to slope toward the up-down direction center of the injection units 252B on progression toward the tips of the injection nozzles 60.

However, from out of the plural injection nozzles 60 in the respective injection units 252B, the remaining plural injection nozzles 60 other than the injection nozzles 60 positioned at both up-down direction sides of the injection units 252B, extend in the front-rear direction of the injection units 252B, namely, extend in normal directions towards sheet faces of the steel sheet 12.

In the cooling equipment 250 according to the second exemplary embodiment of the present invention, the cooling gas that is injected from the plural injection devices 52A, 52B configuring the injection units 252A has a higher hydrogen concentration than the cooling gas that is injected from the plural injection devices 52C, 52D configuring the injection units 252B. In a down-pass space 28, a hydrogen concentration distribution is formed in which an upstream region where the injection units 252A are disposed has a higher hydrogen concentration than a downstream region where the injection units 252B are disposed.

Note that the hydrogen concentration may be the same in the cooling gas for injection in the injection devices 52A and the injection devices 52B, or the hydrogen concentration in the cooling gas for injection by the injection devices 52A may be higher than for the injection devices 52B. Similarly, the hydrogen concentration may be the same in the cooling gas for injection in the injection devices 52C and the injection devices 52D, or the hydrogen concentration in the cooling gas for injection by the injection devices 52C may be higher than for the injection devices 52D.

Moreover, in the cooling equipment 250 according to the second exemplary embodiment of the present invention, an air intake port 64 is formed corresponding to each of the injection units 252A, 252B. The upstream injection units 252A and the upstream air intake port 64 are connected to a circulation system similar to that of the first exemplary embodiment. Similarly, the downstream injection units 252B and the downstream air intake port 64 are also connected to a circulation system.

The upstream air intake port 64 is preferably disposed between the injection nozzles 60 positioned at both up-down direction sides of the injection units 252A. In the present exemplary embodiment, as an example, the upstream air intake port 64 is disposed at a center portion of a high hydrogen concentration region where the injection units 252A (the plural injection devices 52A, 52B) are disposed.

The downstream air intake port 64 is also preferably disposed between the injection nozzles 60 positioned at both up-down direction sides of the injection units 252B. In the present exemplary embodiment, as an example, the downstream air intake port 64 is disposed at a center portion of a low hydrogen concentration region where the injection units 252B (the plural injection devices 52C, 52D) are disposed.

Explanation follows regarding the operation and advantageous effects of the second exemplary embodiment of the present invention.

In the cooling equipment 250 according to the second exemplary embodiment of the present invention, similarly to in the first exemplary embodiment of the present invention, the cooling gas that is injected from the injection units 252A configured by the plural upstream injection devices 52A, 52B is set with a higher hydrogen concentration than that of the cooling gas that is injected from the injection units 252B configured by the plural downstream injection devices 52C, 52D. A hydrogen concentration distribution is accordingly formed in the down-pass space 28 in which an upstream region where the injection units 252A are disposed has a higher hydrogen concentration than a downstream region where the injection units 252B are disposed.

Thus, the speed of cooling after soaking the steel sheet 12, namely the speed of cooling from starting cooling the steel sheet 12 in the cooling zone 20, can be raised, enabling the steel sheet 12 to be cooled rapidly from a higher temperature state. This thereby enables, for example, a high strength to be obtained even while suppressing the amounts of alloy such as silicon (Si) and manganese (Mn) to small amounts.

Moreover, the cooling gas that is injected from the downstream injection units 252B is set with a lower hydrogen concentration than the cooling gas that is injected from the upstream injection units 252A. A reduction can accordingly be achieved in the amount of hydrogen used.

Moreover, from out of the plural injection nozzles 60 in each of the injection units 252, the injection nozzles 60 that are positioned at both up-down direction sides of the injection units 252 are inclined so as to slope toward the up-down direction center of the injection devices 52 on progression toward the tips of the injection nozzles 60. The cooling gas injected from the injection nozzles 60 at both sides is injected toward the up-down direction center of the injection units 252. The cooling gas injected from the injection nozzles 60 at both sides and hitting the steel sheet 12 can accordingly be suppressed from spreading up and down the injection units 252.

This means that a hydrogen concentration distribution can be maintained in which the upstream region where the injection units 252A are disposed has a higher hydrogen concentration than a downstream region where the injection units 252B are disposed, enabling even further reductions in the amount of hydrogen used.

Moreover, from out of the plural injection nozzles 60 in each of the injection units 252, the remaining plural injection nozzles 60, other than the injection nozzles 60 positioned at both up-down direction sides of the injection units 252, extend in normal directions towards sheet faces of the steel sheet 12. The cooling gas injected from these remaining injection nozzles 60 is therefore injected in normal directions towards sheet faces of the steel sheet 12. Thus, the cooling gas is injected with the shortest distance from the remaining injection nozzles 60 to the steel sheet 12, and this cooling gas hits the steel sheet 12 perpendicularly. This enables the steel sheet 12 to be cooled with good efficiency, and enables the steel sheet 12 cooling performance to be raised.

Moreover, the upstream air intake port 64 is disposed between the injection nozzles 60 positioned at both up-down direction sides in the injection units 252A. Thus the cooling gas injected from the plural injection nozzles 60 in the injection units 252A is sucked into the upstream air intake port 64 without diffusing, enabling the cooling gas to be recovered with good efficiency by the upstream air intake port 64. Similarly, the downstream air intake port 64 is also disposed between the injection nozzles 60 positioned at both up-down direction sides in the injection units 252B. Thus the cooling gas injected from the plural injection nozzles 60 in the injection units 252B can be recovered with good efficiency by the downstream air intake port 64.

Moreover, the intermediate sealing device 56 seals between the injection units 252A and the injection units 252B. An appropriate hydrogen concentration distribution can accordingly be maintained due to being able to suppress cooling gas from flowing out from one region to another region for regions positioned on each of the two sides of the intermediate sealing devices 56.

Explanation follows regarding a modified example of the second exemplary embodiment of the present invention.

In the second exemplary embodiment, from out of the plural injection nozzles 60 in the injection units 252A, the remaining plural injection nozzles 60, other than the injection nozzles 60 positioned at both up-down direction sides of the injection units 252A, extend in normal directions towards sheet faces of the steel sheet 12.

Figure 16:
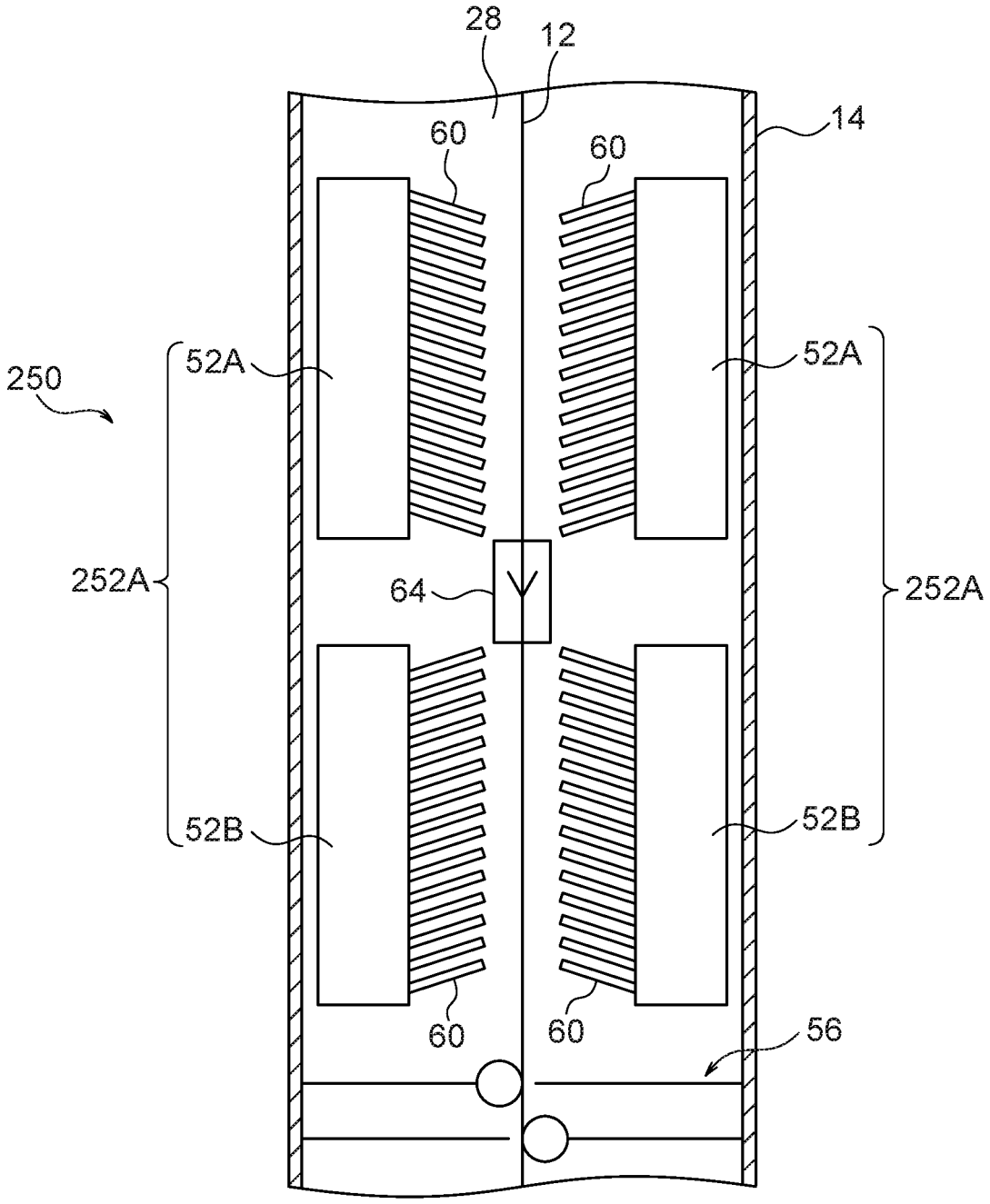
FIG. 16 is a face-on view illustrating a first modified example of an upstream injection unit of FIG. 15.

However, for example, as illustrated in FIG. 16, in the upstream injection devices 52A from out of the plural injection devices 52A, 52B configuring the injection units 252A, all of the plural injection nozzles 60 may be inclined so as to slope downward in the up-down direction of the injection devices 52A on progression toward the tips of the injection nozzles 60. Moreover, in the downstream injection devices 52B from out of the plural injection devices 52A, 52B configuring the injection units 252A, all of the plural injection nozzles 60 may be inclined so as to slope upward in the up-down direction of the injection devices 52B on progression toward the tips of the injection nozzles 60. Namely, all of the plural injection nozzles 60 in the injection units 252A may be inclined.

Adopting such a configuration enables the cooling gas injected from the injection units 252A to be even further suppressed from spreading in the up and down directions of the injection units 252A.

Figure 17:
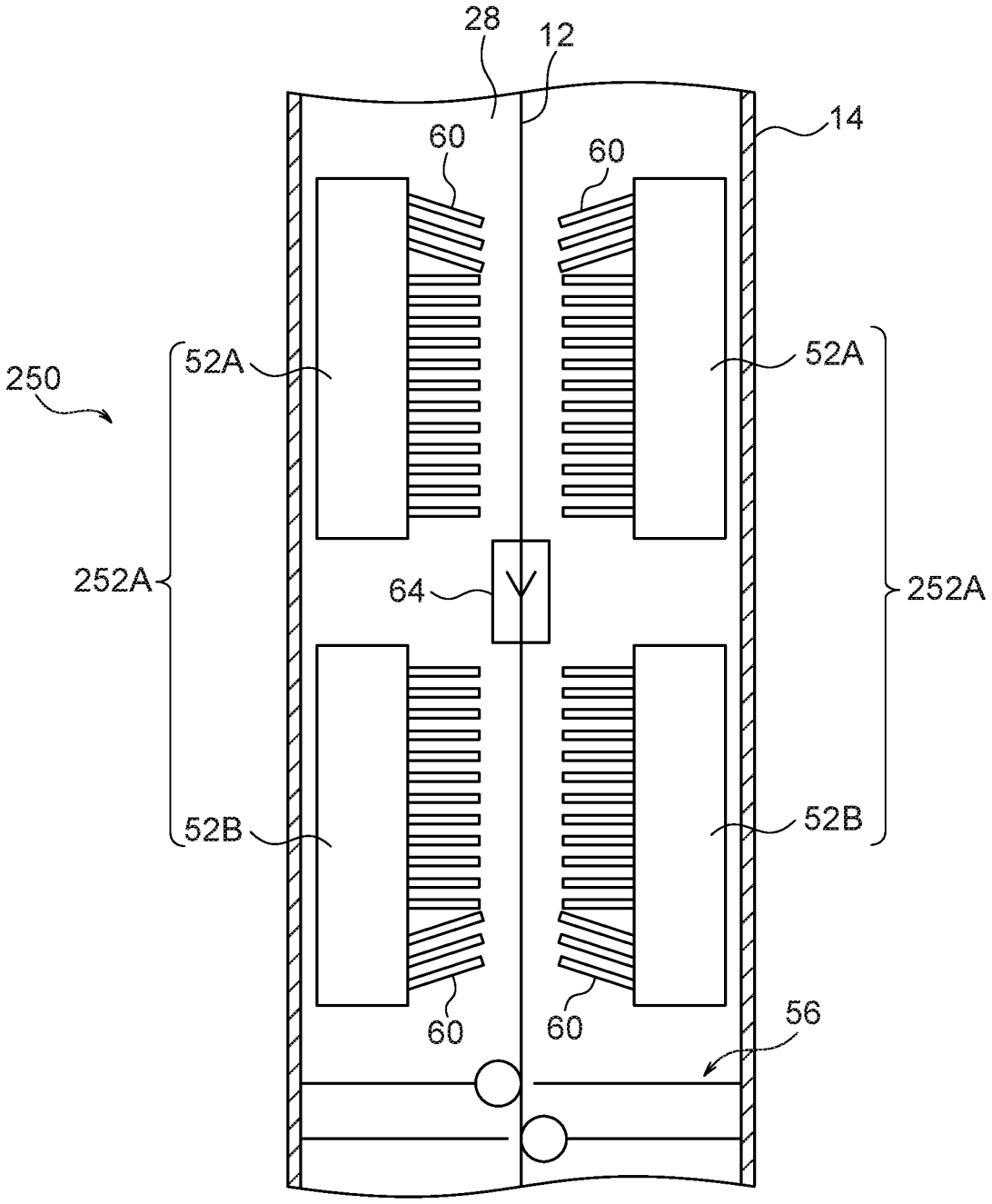
FIG. 17 is a face-on view illustrating a second modified example of the upstream injection unit of FIG. 15.

Moreover, for example as illustrated in FIG. 17, in the upstream injection devices 52A from out of the plural injection devices 52A, 52B configuring the injection units 252A, plural injection nozzles 60 on the upper side may be inclined so as to slope downward in the up-down direction of the injection devices 52A on progression toward the tips of the injection nozzles 60. Moreover, in the downstream injection devices 52B from out of the plural injection devices 52A, 52B configuring the injection units 252A, plural injection nozzles 60 on the lower side may be inclined so as to face upward in the up-down direction of the injection devices 52B on progression toward the tips of the injection nozzles 60. Namely, plural of the injection nozzles 60 provided at both up-down direction sides of the injection units 252A may be inclined.

Adopting such a configuration enables the cooling gas injected from the upstream injection units 252A to be suppressed from spreading in the up-down direction of the injection units 252A by an amount commensurate with the increased number of inclined injection nozzles 60.

Moreover, in the modified examples illustrated in FIG. 16, FIG. 17, the upstream injection devices 52A from out of the plural injection devices 52A, 52B configuring the injection units 252A may be configured such that an inclination angle decreases sequentially from the injection nozzles 60 on the upper side to the injection nozzles 60 on the lower side. Moreover, the downstream injection devices 52B from out of the plural injection devices 52A, 52B configuring the injection units 252A may be configured such that an inclination angle decreases sequentially from the injection nozzles 60 on the lower side to the injection nozzles 60 on the upper side.

Moreover, although in the second exemplary embodiment the injection units 252A are configured, as an example, by the two stages of the injection devices 52A, 52B, the injection units 252A may be configured with any number of stages of injection devices.

Figure 18:
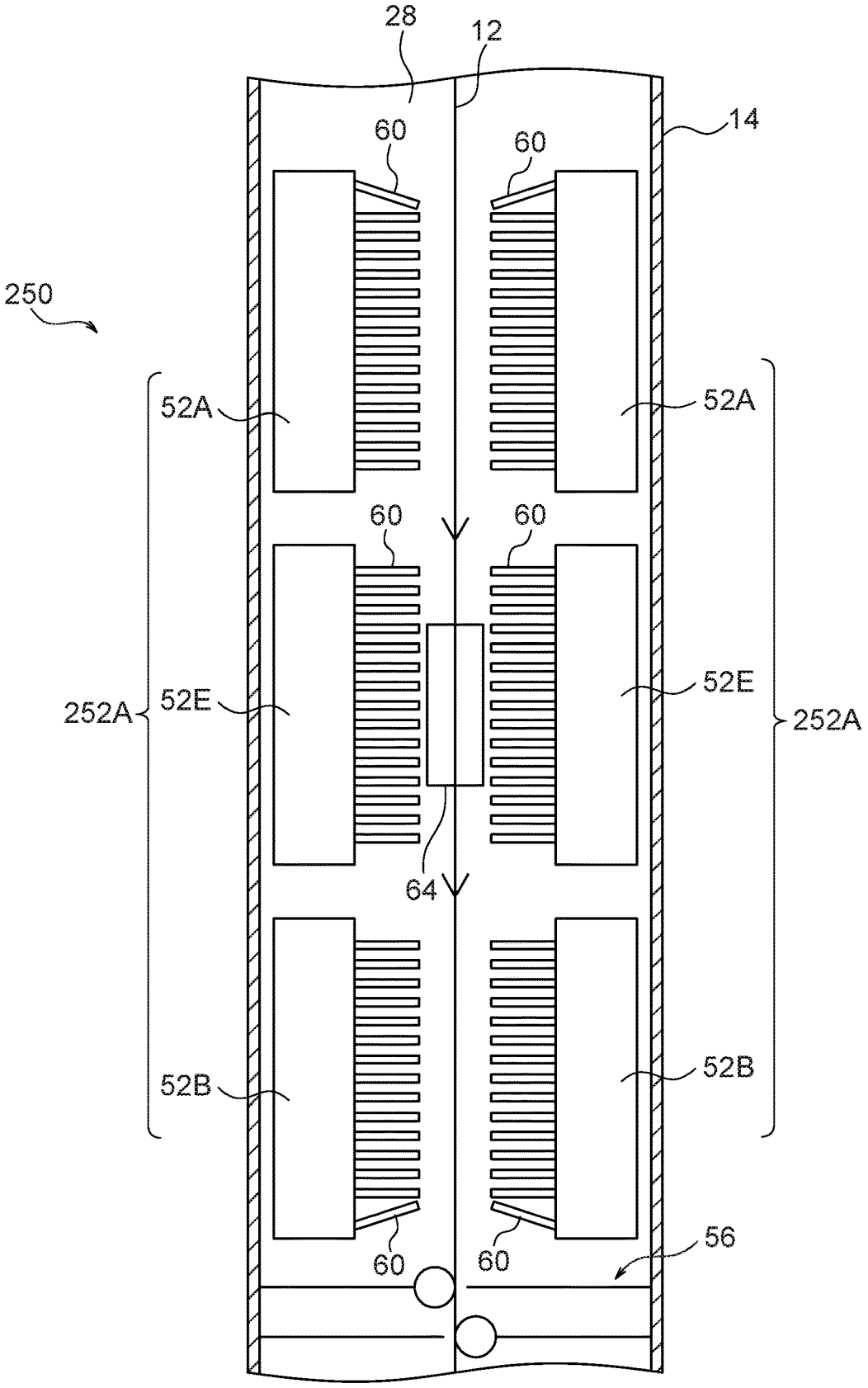
FIG. 18 is a face-on view illustrating a third modified example of the upstream injection unit of FIG. 15.
Figure 19:
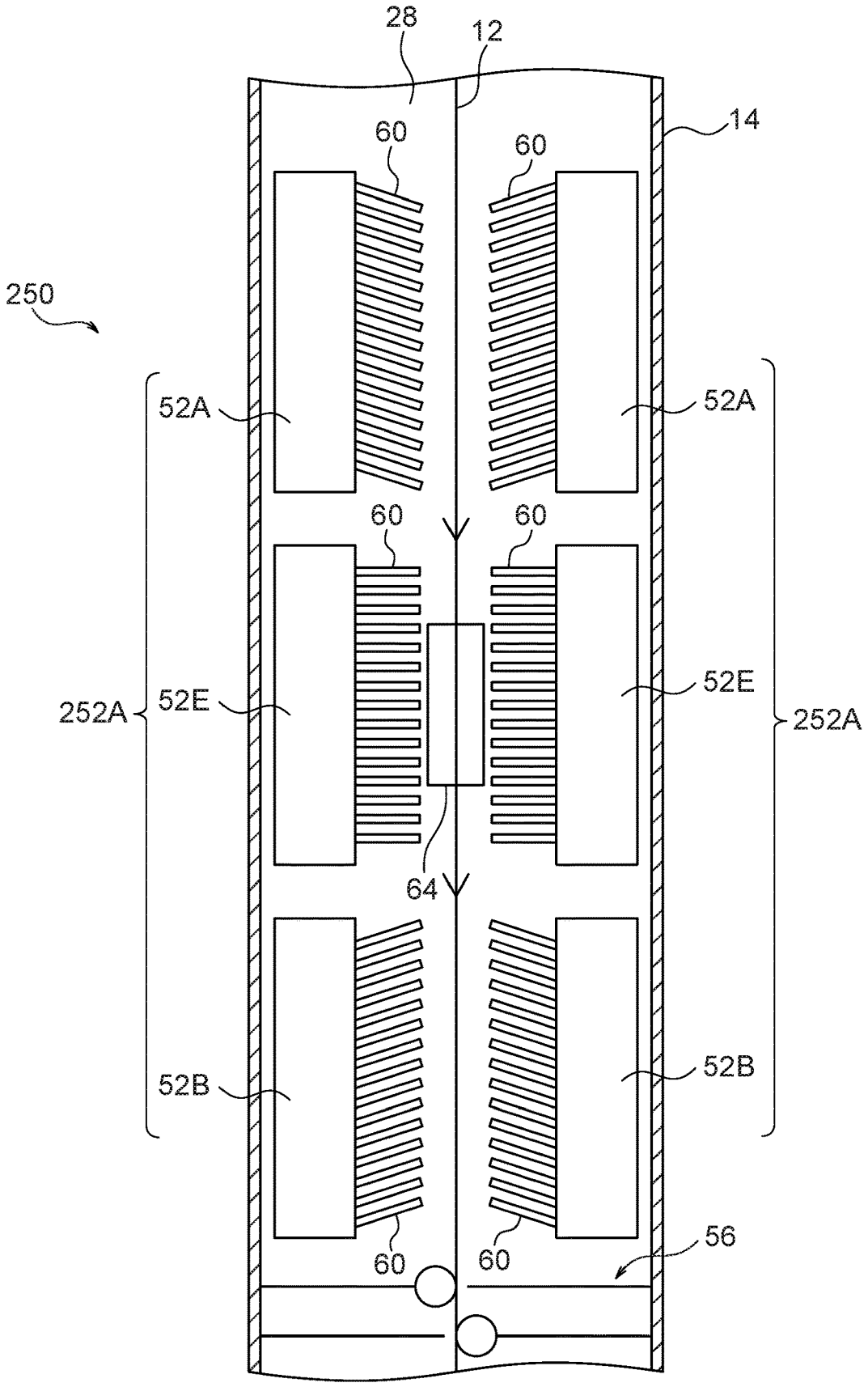
FIG. 19 is a face-on view illustrating a fourth modified example of an upstream injection unit of FIG. 15.

For example, modified examples are illustrated in FIG. 18 and FIG. 19 in which the injection units 252A are configured with three stages of the injection devices. The modified example illustrated in FIG. 18 is an example in which intermediate injection devices 52E have been added to the modified example illustrated in FIG. 15, by insertion between the upstream injection devices 52A and the downstream injection devices 52B of the injection units 252A. Moreover, the modified example illustrated in FIG. 19 is an example in which intermediate injection devices 52E have been added to the modified example illustrated in FIG. 16, by insertion between the upstream injection devices 52A and the downstream injection devices 52B of the injection units 252A.

As illustrated in FIG. 18 and FIG. 19, in cases in which the injection units 252A are provide with the intermediate injection devices 52E, plural injection nozzles 60 in the intermediate injection devices 52E may extend in normal directions towards sheet faces of the steel sheet 12.

Note that a modified example may also be adopted for the plural injection nozzles 60 in the injection units 252B too, similar to the modified example for the plural injection nozzles 60 in the injection units 252A described above.

Moreover, in the second exemplary embodiment, the injection units 252A have the same configuration as the injection units 252B, and the arrangement of the plural injection nozzles 60, and the number of inclined injection nozzles 60 etc. are the same in the injection units 252A and the injection units 252B. However, the arrangement of the plural injection nozzles 60, and the number of inclined injection nozzles 60 etc. may be different in the injection units 252A to in the injection units 252B. Moreover, there may be a different number of stages of injection devices for the injection units 252A and the injection units 252B.

In the second exemplary embodiment, similar modified examples may be adopted for the configuration of the intermediate sealing device 56 and the arrangement position of the cooling equipment 250 to those of the first exemplary embodiment.

Moreover, although in the second exemplary embodiment the cooling equipment 250 includes the intermediate sealing device 56, the intermediate sealing device 56 may be omitted.

This concludes the description of the first and second exemplary embodiments of the present invention. However, the present invention is not limited to the above, and obviously various modifications may be implemented within a scope not departing from the spirit of the present invention.

The invention claimed is:

1. Cooling equipment for a continuous annealing furnace, the cooling equipment comprising:

a plurality of injection units disposed in a continuous annealing furnace including a heating zone, a soaking zone, and a cooling zone through which a strip-shaped steel sheet is sequentially fed, the plurality of injection units each being arranged in the cooling zone in sequence from upstream to downstream in a feed direction of the steel sheet and injecting, from a plurality of injection nozzles, a hydrogen-containing cooling gas, onto the steel sheet; and a plurality of circulation systems that connect a plurality of air intake ports, which suck in the cooling gas injected from each of the plurality of injection units, with each of the plurality of injection units;

each of the plurality of circulation systems including an out-path pipe that is connected to one of the plurality of injection units, a return-path pipe that is connected to one of the plurality of air intake ports, a heat exchanger that is connected to the out-path pipe and the return-path pipe, a hydrogen supply source that is connected to the out-path pipe, and a blower that is provided on the out-path pipe; and the hydrogen supply sources of upstream circulation systems configured to supply more hydrogen into the out-path pipe than the hydrogen supply sources of downstream circulation systems such that a hydrogen concentration distribution is formed in which, in a space of the cooling zone where the plurality of injection units are disposed, a hydrogen concentration at an upstream region is higher than a hydrogen concentration at a downstream region;

wherein:

each plurality of injection nozzles in the plurality of injection units is arranged with an array direction along the feed direction of the steel sheet, and each of the plurality of injection nozzles extends toward the steel sheet;

at least injection nozzles positioned at both sides in the array direction in each of the plurality of injection nozzles are inclined so as to slope toward a center of the array direction on progression toward tips of the injection nozzles, and each of the plurality of air intake ports is disposed between injection nozzles, among the plurality of injection nozzles, positioned at both sides in the array direction.

2. The continuous annealing furnace cooling equipment of claim 1, wherein, in each of the plurality of injection nozzles, injection nozzles other than the injection nozzles positioned at both sides in the array direction extend in normal directions towards sheet faces of the steel sheet.

3. The continuous annealing furnace cooling equipment of claim 1, further comprising an intermediate sealing device disposed between the plurality of injection units, wherein:

the intermediate sealing device includes an upstream support roll to support the steel sheet from one sheet thickness direction side of the steel sheet;

a downstream support roll disposed downstream of the upstream support roll in the feed direction of the steel sheet and supporting the steel sheet from another sheet thickness direction side of the steel sheet;

an upstream first seal disposed at an opposite side of the upstream support roll to the steel sheet and extending from an inner wall of a furnace body forming the cooling zone toward the upstream support roll;

an upstream second seal disposed at an opposite side of the steel sheet to the upstream support roll and extending from an inner wall of the furnace body toward the steel sheet;

a downstream first seal disposed at an opposite side of the downstream support roll to the steel sheet and extending from an inner wall of the furnace body toward the downstream support roll;

a downstream second seal disposed at an opposite side of the steel sheet to the downstream support roll and extending from an inner wall of the furnace body toward the steel sheet;

an upstream roll seal that together with the upstream support roll closes a gap between the upstream first seal and the steel sheet; and a downstream roll seal that together with the downstream support roll closes a gap between the downstream first seal and the steel sheet.

* * * * *